US005142879A

United States Patent [19]

Nakamura et al.

[11] Patent Number: 5,142,879

[45] Date of Patent: Sep. 1, 1992

[54] AIR CONDITIONING SYSTEM

[75] Inventors: Takashi Nakamura; Tomohiko Kasai; Hidekazu Tani; Shigeo Takata; Fumio Matsuoka, all of Kamakura, Japan

[73] Assignee: Mitsubishi Denki Kabushiki Kaisha, Tokyo, Japan

[21] Appl. No.: 672,071

[22] Filed: Mar. 19, 1991

[30] Foreign Application Priority Data

| | | | |
|---|---|---|---|
| Mar. 19, 1990 | [JP] | Japan | 2-68955 |
| Apr. 23, 1990 | [JP] | Japan | 2-107916 |
| Apr. 23, 1990 | [JP] | Japan | 2-107917 |
| Apr. 23, 1990 | [JP] | Japan | 2-107930 |

[51] Int. Cl.[5] ..... F25B 13/00

[52] U.S. Cl. ..... 62/160; 62/211; 62/324.6

[58] Field of Search ..... 62/160, 211, 324.6

[56] References Cited

U.S. PATENT DOCUMENTS

| | | | |
|---|---|---|---|
| 4,621,505 | 11/1986 | Ares et al. | 62/509 |
| 4,878,357 | 11/1989 | Sekigami et al. | 62/324.6 X |
| 5,040,376 | 8/1991 | Ueno | 62/324.6 X |

FOREIGN PATENT DOCUMENTS

| | | | |
|---|---|---|---|
| 0316685 | 5/1989 | European Pat. Off. . | |
| 3220335 | 5/1982 | Fed. Rep. of Germany . | |
| 0057346 | 5/1979 | Japan | 62/324.6 |
| 62-56429 | 11/1987 | Japan . | |
| 1302074 | 12/1989 | Japan . | |
| 2194651 | 3/1988 | United Kingdom . | |
| 2213248 | 8/1989 | United Kingdom . | |

*Primary Examiner*—William E. Wayner

*Attorney, Agent, or Firm*—Oblon, Spivak, McClelland, Maier & Neustadt

[57] ABSTRACT

An air conditioning system for multiple rooms, comprising:

an outdoor unit including a variable delivery compressor, a four way reversing valve and an outdoor heat exchange unit;

two main connecting pipes composed of a high pressure main pipe and a low pressure main pipe to connect between outdoors and indoors;

a distribution controller which is connected to the main connecting pipes to divide them into a high pressure pipe, a low pressure pipe and a medium pressure pipe therein;

a plurality of indoor units which include indoor heat exchangers, respectively, which are one end connected to the medium pressure pipe through electronic expansion valves, respectively, and which are the other end selectively connected to either one of the high pressure pipe and the low pressure pipe, respectively;

detecting means for detecting either one of refrigerant temperatures and refrigerant pressures; and control means for carrying out a predetermimed control based on such detection.

6 Claims, 16 Drawing Sheets

AIR CONDITIONING SYSTEM

The present invention relates to an air conditioning system for multiple rooms which has an outdoor unit and a plurality of indoor units connected through two refrigerant pipes, and which works as a cooling and heating concurrent multiple air conditioning system capable of carrying out a cooling operation mode and a heating operation mode in the respective indoor units selectively and individually.

Referring to FIG. 17, there is shown a schematic diagram showing a conventional air conditioning system for multiple rooms, which has been disclosed in e.g. Japanese Unexamined Patent Publication No. 302074/1989. In FIG. 17, reference numeral 1 designates an outdoor unit. Reference numeral 2 designates a variable delivery compressor. Reference numeral 3 designates a four way reversing valve. Reference numeral 4 designates an outdoor heat exchanger. Reference numeral 5 designates an outdoor expansion valve. Reference numerals 6*a*, 6*b* and 6*c* designate indoor units. Reference numerals 8*a*, 8*b* and 8*c* designate indoor heat exchangers. Reference numeral 9 designates an outdoor fan. Reference numerals 10*a*, 10*b* and 10*c* designate indoor fans. Reference numeral 11 designates a header. Reference numerals 12*a*, 12*b* and 12*c* designate indoor first two way valves. Reference numerals 13*a*, 13*b* and 13*c* designate indoor second two way valves. Reference numerals 14*a*, 14*b* and 14*c* designate indoor first expansion valves. Reference numerals 15*a*, 15*b* and 15*c* designate indoor second expansion valves. Reference numeral 16 designates a two way valves.

The operation of the conventional system will be described. The refrigerant which has been compressed by the compressor 2 to become a gas having high temperature and high pressure passes through the four way reversing valve 3, and is partly condensed and liquefied in the outdoor heat exchanger 4 to become a two phase refrigerant having medium pressure. Then it is transmitted indoors through the outdoor expansion valve 5. When the indoor unit 6*a* is under a heating mode, and the indoor units 6*b* and 6*c* are under a cooling mode, the two phase refrigerant which has been forwarded indoors and has medium pressure passes through the indoor first two valve 12*a*, and is condensed and liquified in the indoor heat exchanger 8*a*. The refrigerant thus liquefied passes through the indoor second expansion valve 15*a*, and is stored as liquid in the header 11. The liquid refrigerant which has medium pressure passes through the indoor first expansion valves 14*b* and 14*c* of the indoor units 6*b* and 6*c*, and enters the respective indoor heat exchangers 8*b* and 8*c*. The refrigerant which has evaporated in the indoor heat exchangers under low pressure to gasify returns to the outdoor unit 1*a* through the indoor second two way valves 13*b* and 13*c*. After that, the refrigerant goes back to the compressor 2 again through the four way reversing valve 3. In this manner, a refrigerant cycle is formed.

The structure of the conventional air conditioning system as stated earlier requires the capacity control for the compressor 2, the air volume control for the outdoor fan 9, the control for the outdoor expansion valve 5, the control for the outlet expansion valve 15*a* of the indoor unit 6*a* under the heating mode, and the control for the inlet expansion valves 14*b* and 14*c* of the indoor units 6*b* and 6*c* under the cooling mode. This creates a problem wherein signals required for these controls are transmitted to and fro between the indoor units and the outdoor unit to complicate these controls, failing in reliability and performance stability.

On the other hand, there has been known a heat pump type air conditioning system wherein a single heat source device is connected to a plurality of indoor units through two pipes, i.e., a gas pipe and liquid pipe, and wherein either heating or cooling is carried out in all indoor units at the same time.

Since this conventional multi-room heat pump type air conditioning system has been constructed as stated above, all indoor units can carry out either one of heating and cooling at the same time which creates a problem wherein a room required for cooling is subjected to heating, and wherein a room required for heating is subjected to cooling. In particular, when such air conditioning system is installed in a large-scale building, the problem as stated just above is serious because interior zones and perimeter zones, or ordinary office rooms and office-automated rooms such as computer rooms are totally different in terms of air conditioning load.

It is an object of the present invention to solve the first problem, and to provide an air conditioning system for multiple rooms capable of simplifying controls, and of improving reliability and performance stability.

It is an object of the present invention to solve the second problem, and to provide a multi-room heat pump type air conditioning system wherein a single heat source device is connected to a plurality of indoor units, and the respective indoor unit can selectively and individually carry out either cooling or heating, whereby even if interior zones and perimeter zones, or ordinary office rooms and office-automated rooms such as computer rooms are totally different in terms of air conditioning load in the case of installment of the system in a large-scale building, the system can cope with the requirements of cooling and heating the spaces with the respective indoor units installed in them.

In order to attain the first object, the present invention provides an air conditioning system for multiple rooms, comprising an outdoor unit including a variable delivery compressor, a four way reversing valve and an outdoor heat exchange unit; two main connecting pipes composed of a high pressure main pipe and a low pressure main pipe to connect between outdoors and indoors; a distribution controller which is connected to the main connecting pipes to divide them into a high pressure pipe, a low pressure pipe and a medium pressure pipe therein: a plurality of indoor units which include indoor heat exchangers, respectively, which one end connected to the medium pressure pipe through electronic expansion valves, respectively, and which are the other end selectively connected to either one of the high pressure pipe and the low pressure pipe, respectively; detecting means for detecting either one of refrigerant temperatures and refrigerant pressures; and control means for carrying out a predetermined control based on such detection.

According to an aspect of the present invention, the detecting means constituted by air temperature sensors for detecting intake air temperatures Tai at the indoor heat exchangers, and first refrigerant sensors and second refrigerant sensors for detecting refrigerant temperatures $T_{R1}$ at the refrigerant inlets of the indoor heat exchangers and refrigerant temperatures $T_{R2}$ at the refrigerant outlets thereof, respectively; and the control means controls the electronic expansion valves of the indoor heat exchangers based on logarithmic mean temperature differences at the respective indoor heat exchangers, and on desired temperatures and the actual temperatures for rooms with the indoor units installed therein.

According to another aspect of the present invention, the detecting means is constituted by either one of pressure detecting means for detecting a pressure at a high pressure pipe and a pressure at a low pressure pipe in the outdoor unit, and temperature detecting means for detecting a condensing temperature and an operating temperature; there is provided calculation means for making calculation using either one of the following equations:

$$\left(\frac{\Delta Q_{comp}}{\Delta Ake}\right)=\begin{pmatrix} A & B \\ C & D \end{pmatrix}\begin{pmatrix} \Delta Pd \\ \Delta Ps \end{pmatrix} \text{and}$$

$$\left(\frac{\Delta Q_{comp}}{\Delta Ake}\right)=\left(\frac{A' \; B'}{C' \; D'}\right)\begin{pmatrix} \Delta CT \\ \Delta ET \end{pmatrix}$$

(Wherein $\Delta Q_{comp}$ is a capacity variable for the compressor, ΔAke is heat exchange capacity variable for the outdoor heating exchanger, A, B, C, D, A', B', C' and D' are constants, ΔPd is a control led deviation between a desired value and a detected value at the high pressure pipe in the outdoor unit, ΔPs is a control led deviation between a desired value and a detected value at the low pressure pipe in the outdoor unit, ΔCT is a control led deviation between a desired value and a detected value with respect to the condensing temperature, and ΔET is a control led deviation between a desired value and a detected value with respect to the evaporating temperature; and the control means controls the compressor, the four way reversing valve in the outdoor unit and the outdoor heat exchanger unit based on such calculation.

According to a further aspect of the present invention, the outdoor unit includes an outdoor fan; the outdoor heat exchange unit comprises a plurality of outdoor heat exchangers connected in parallel; at least one of the outdoor heat exchangers is provided with an on-off valve; a bypass passage is connected in parallel with the outdoor heat exchangers, and having an on-off valve therein; the detecting means is constituted by a high pressure detecting means arranged in the outdoor unit for detecting a high pressure Pd, and a low pressure detecting means arranged in the outdoor unit for detecting a low pressure Ps; and the control means finds a compressor capacity variable $\Delta Q_{comp}$ and an outdoor unit heat exchange variable $\Delta Ak_0$ based on a control led deviation (ΔPd=Pd*−Pd) between a desired high pressure Pd* and the detected high pressure, and a control led deviation (ΔPs=Ps*−Ps) between a desired low pressure Ps* and the detected low pressure, thereby to control the capacity of the compressor based on the found $\Delta Q_{comp}$, and also to control the heat exchange capability of the outdoor heat exchange unit by controlling the on-off valve of the at least one outdoor heat exchanger, the bypass passage on-off valve and the outdoor fan based on the found $\Delta Ak_0$.

According to a still further aspect of the present invention, the outdoor unit includes an outdoor fan; the outdoor heat exchange unit comprises a plurality of outdoor heat exchangers connected in parallel; at least one of the heat exchangers is provided with an on-off valve; a bypass passage is connected in parallel with the outdoor heat exchangers, and having an on-off valve therein; the detecting means is constituted by detecting means for detecting a refrigerant condensing temperature CT and a refrigerant evaporating temperature ET in the outdoor unit and the indoor units; and the control means finds a compressor capacity variable $\Delta Q_{comp}$ and an outdoor unit heat exchange variable $\Delta Ak_0$ based on a controlled deviation (ΔCT=CT*−CT) between a desired condensing temperature CT* and the detected condensing temperature, and a controlled deviation (ΔET=ET*−ET) between a desired evaporating temperature ET* and the detected evaporating temperature, thereby to control the capacity of the compressor based on the found $\Delta Q_{comp}$, and also to control the heat exchange capability of the outdoor heat exchange unit by controlling the on-off valve of the at least one outdoor heat exchanger, the bypass passage on-off valve and the outdoor fan based on the found $\Delta Ak_0$.

In order to attain the second object, the present invention also provides an air conditioning system comprising a single outdoor unit including a compressor, a four way reversing valve, an outdoor heat exchange unit, a variable air volume type of outdoor fan for feeding air to the outdoor heat exchange unit, and an accumulator; a first main connecting pipe and a second main connecting pipe; a plurality of indoor units connected to the outdoor unit through the main connecting pipes, and including indoor heat exchangers and first flow controllers; a first branch joint which is provided with valve systems to selectively connect one end of the indoor heat exchangers to either one of the first main connecting pipe and the second main connecting pipe; a second branch joint which is connected to the other end of the indoor heat exchangers through the first flow controller, and which is also connected to the second connecting pipe through a second flow controller; the first branch joint and the second branch joint being connected together through the second flow controller; the second branch joint and the first main connecting pipe being connected together through a fourth flow controller; a junction device which includes the first branch joint, the second branch joint, the second flow controller and the fourth flow controller, and which is interposed between the outdoor unit and the indoor unit; the outdoor heat exchanger unit being constituted by a plurality of outdoor heat exchangers connected together in parallel and having both ends provided with electromagnetic on-off valves, and an outdoor bypass passage connected in parallel with the outdoor heat exchangers and having an electromagnetic on-off valve therein; a fourth pressure detected means arranged at location between the outdoor heat exchangers and the four way reversing valve; and an outdoor unit heat exchange capacity adjusting means for controlling the air volume of the outdoor fan, the electromagnetic on-off valves at both ends of the outdoor heat exchangers and the electromagnetic on-off valve in the outdoor bypass passage so that the pressure detected by the fourth pressure detecting means achieves a desired pressure.

In drawings:

FIG. 1 is a schematic diagram of a first embodiment of the air conditioning system according to the present invention;

FIGS. 2*a*, 2*b* and 2*c* are graphs to help explain the operation controls of the first embodiment;

The present invention will be described in detail with reference to preferred embodiments illustrated in the accompanying drawings.

Figure 1:
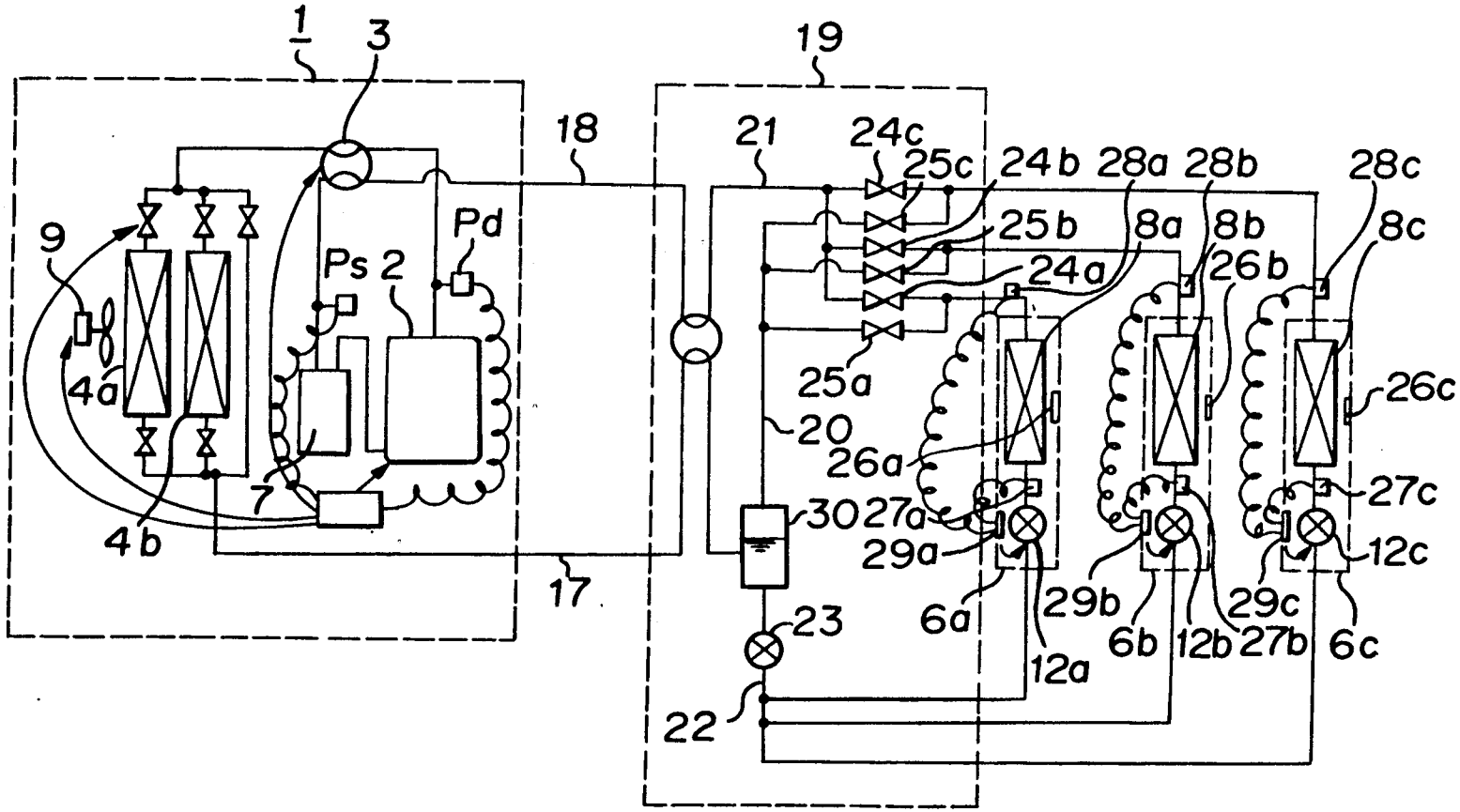

A first embodiment of the present invention will be described with reference to the drawings. In FIG. 1, reference numeral 1 designates an outdoor unit. Reference numeral 2 designates a variable delivery compressor which is arranged in the outdoor unit 1. Reference numeral 3 designates a four way reversing valve. Reference numerals 4*a* and 4*b* designate outdoor heat exchangers. Reference numerals 6*a*–6*c* designate indoor units. Reference numeral 7 designates an accumulator. Reference numerals 8*a*–8*c* designate indoor heat exchangers. Reference numerals 12*a*–12*c* designate electronic expansion valves which are connected to each one end of the indoor heat exchangers 8*a*–8*c*. Reference numerals 17 and 18 designate main connecting pipes which connect between the outdoor unit 1 and a distributive controller 19. Reference numeral 20 designates a high pressure pipe which is arranged in the distributive controller 19. Reference numeral 21 designates a low pressure pipe. Reference numeral 22 designates a medium pressure pipe. Reference numeral 23 designates an electronic expansion valve. Reference numerals 24*a*–24*c* and 25*a*–25*c* designate electromagnetic on-off valves. The distributive controller 19 is connected to the respective indoor units 6*a*–6*c* through two branch pipes, respectively. The respective indoor units 6*a*–6*c* have the one end connected to the medium pressure pipe 22 of the distributive controller 19 through the corresponding electronic expansion valves 12*a*–12*c*, respectively. The respective indoor units have the other end connected to the high pressure pipe 20 and the low pressure pipe 21 through the electromagnetic on-off valves 24*a*–24*c* and 25*a*–25*c* of the distributive controller 19, respectively.

The indoor units 6*a*–6*c* are provided with air temperature sensors 26*a*–26*c* for detecting the temperature of intake air, respectively. The indoor units 6*a*–6*c* are also provided, respectively, with first refrigerant temperature sensors 27*a*–27*c* and second refrigerant temperature sensors 28*a*–28*c* for detecting the refrigerant inlet and outlet temperature at the opposite ends of the heat exchangers 8*a*–8*c*. The indoor units 6*a*–6*c* include microcomputers 29*a*–29*c*, respectively, which work as control means to control the electronic expansion valves 12*a*–12*c* based on detection temperature signals from these sensors, and actual temperatures and set temperatures for each room.

In the air conditioning system having such structure, the operations which are made when the indoor unit 6*a* is under a heating operation mode, and the indoor units 6*b* and 6*c* are under a cooling operation mode will be described.

The refrigerant which has been compressed by the compressor 2 in the outdoor unit 1 to become a gas having high temperature and high pressure passes through the four way reversing valve 3, and is partly condensed in the outdoor heat exchangers 4*a* and 4*b* to become a two phase refrigerant. The two phase refrigerant enters the indoor distributive controller 19 through the main connecting pipe 17 having high pressure. The high pressure gaseous refrigerant which has been separated in a gas-liquid separator 30 passes through the high pressure gas pipe 20, and enters the indoor unit 6*a* through the electromagnetic on-off valve 25*a* to be used in the indoor heat exchanger 8*a* for heating. After that, the refrigerant enters the medium pressure pipe 22 through the electronic expansion valve 12*a*. The refrigerant joins with the refrigerant which has come into the medium pressure pipe 22 from a liquid layer portion in the gas-liquid separator 30 through the electronic expansion valve 23. The refrigerant thus joined enters the indoor units 6*b* and 6*c*. The refrigerant is depressurized by the electronic expansion valves 12*b* and 12*c*, and is used in the indoor heat exchangers 8*b* and 8*c* for cooling to be gasified. After that, the refrigerant joins together in the low pressure pipe 21 through the electromagnetic on-off valves 24*b* and 24*c*, comes out of the distributive controller 19, and enters the main pipe 18 which directs the refrigerant outdoors. Then, the refrigerant passes through the four way reversing valve 3 and the accumulator 7 in the outdoor unit 1, and returns to the compressor 2 again. In this manner, a refrigerant circuit for cooling and heating concurrent operation is formed.

In the refrigerant circuit, the heat exchanger 8*a* in the indoor unit 6*a* works as a condenser whereas the heat exchangers 8*b* and 8*c* in the indoor units 6*b* and 6*c* function as evaporators.

The capability control for the respective indoor units 6*a*–6*c* under such operations is made as follows: The indoor unit 6*a* is exemplified for illustration. The temperature Tai of the air which is inspired into the indoor unit 6*a* is detected by the air temperature sensor 26*a*, the temperature $T_{R2}$ at the refrigerant inlet side of the indoor heat exchanger 8*a* is detected the second refrigerant temperature sensor 28*a*, and the temperature $T_{R1}$ at the refrigerant outlet side of the indoor heat exchanger 8*a* is detected by the first refrigerant temperature sensor 27*a*. Detection temperature signals indicative of the temperatures detected by the sensors are transmitted to the microcomputer 29a. The microcomputer 29a can find a logarithmic mean temperature difference Δtm in the indoor heat exchanger 8a, using the equation (1):

$$\Delta tm = \frac{(Tai - T_{R1}) - (Tai - T_{R2})}{\log \frac{Tai - T_{R1}}{Tai - T_{R2}}} \quad (1)$$

Figure 2A:
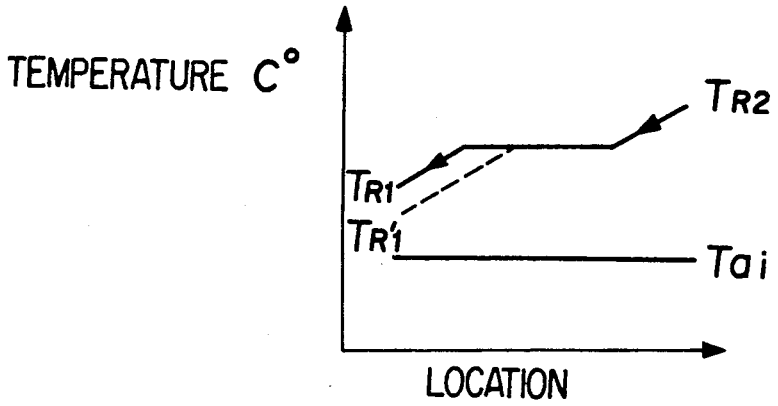

The logarithmic mean difference Δtm is considered as indication of the capability of the heat exchanger, and the capability control of the indoor unit 6a is carried out based on the logarithmic mean temperature difference Δtm. Specifically, the temperature changes from the refrigerant inlet to the refrigerant outlet of the condenser are as shown in FIG. 2a. The capability Q of the condenser is substantially represented by $$Q = A \cdot K \cdot \Delta tm$$

wherein A represents a heat exchange area ($m^2$), and K represents an over-all heat transfer coefficient (kcal/h·°C.). The capability Q can be considered as being proportional to the logarithmic mean temperature difference Δtm. In the FIG. 2a, the refrigerant flows in the direction of arrows.

Figure 2B:
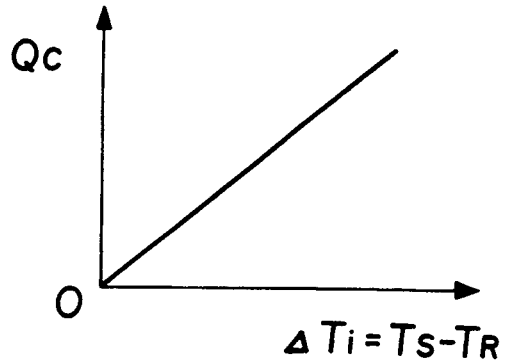
Figure 2C:
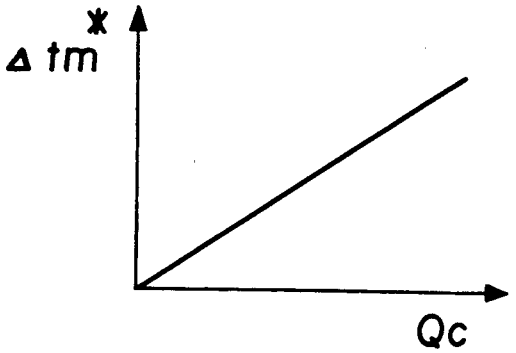

This means that the control based on the temperature difference Δtm enables the capability control. Such control is carried out as follow: A required indoor unit capability is determined from the correlation as shown in FIG. 2b, depending on a controlled deviation ΔTi between an actual room temperature $T_R$ and a set temperature $T_s$ for the room where the indoor unit 6a is installed. A logarithmic mean temperature difference, i.e., desired logarithmic mean temperature difference Δtm* which corresponds to a required indoor unit capability Qc can be found from the correlation as shown in FIG. 2c. Δtm can be brought closer to Δtm* to carry out a desired capability control, which can be realized by controlling the opening angle of the electronic expansion valve 12a. For example, if the electronic expansion valve 12a is further throttled, the temperature changes in the indoor heat exchanger 8a–exhibits so-called sub-cooling to become as indicated by a dashed line in FIG. 2a. As a result, the refrigerant outlet temperature which is detected by the first refrigerant temperature sensor 27a lowers from $T_{R1}$ to $T_{R1}'$ to decrease Δtm, allowing the Capability Qc to lessen.

On the other hand, when a heat exchanger is operated as an evaporator, the opening angle of a corresponding electronic expansion valve is controlled to exert a influence on the superheat at the refrigerant outlet, allowing to the capability control to be carried out. Such controls can be performed at the respective indoor heat exchangers to carry out an autonomous capability control at the respective indoor heat exchangers. An autonomous capability control can be also made at the outdoor unit 1 to dispense with the signal transmission between the indoor units and the outdoor unit.

In accordance with the first embodiment, the intake air temperature Tai, the refrigerant inlet temperature $T_{R1}$ and the refrigerant outlet temperature $T_{R2}$ are detected by the air temperature sensor, and the first and second refrigerant temperature sensors at the respective heat exchangers. The logarithmic mean temperature difference Δtm at each heat exchanger is found by the corresponding control means based on the detected temperatures. Because the logarithmic mean temperature difference Δtm substantially corresponds to the capability of each heat exchanger at that time, the electronic expansion valve which is connected to each heat exchanger can be controlled based on Δtm, the set room temperature for each room and the actual room temperature in each room to carry out the autonomous capability control at each room.

As explained, in accordance with the first embodiment, the respective indoor heat exchangers are provided with the sensors for detecting the intake air temperature, the refrigerant inlet temperature and the refrigerant outlet temperature, and the logarithmic mean temperature difference at the respective heat exchangers is found based on the detected temperatures. The electronic expansion valve which is connected to each indoor heat exchanger is controlled based on the logarithmic mean temperature difference, the actual room temperature and the set room temperature for the room. This arrangement allows the autonomous capability control to be made at each indoor unit, and a decentralized control to be performed among the indoor units, offering the advantage of obtaining an air conditioning system for multiple rooms capable of improving reliability and stabilizing operation performance.

Now, a second embodiment of the present invention will be described.

Figure 3:
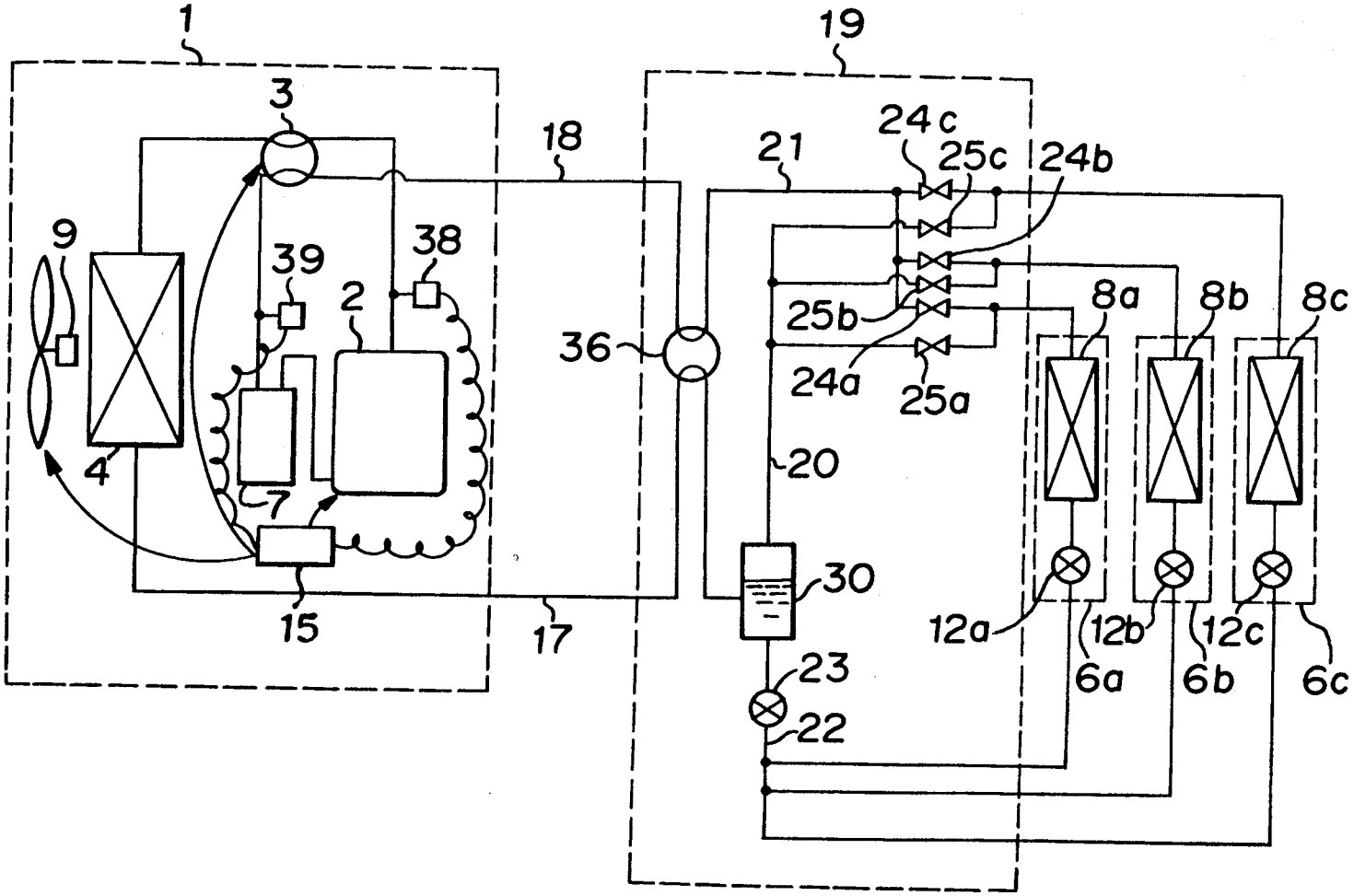
FIG. 3 is a schematic diagram of a second embodiment.

Referring now to FIG. 3, there is shown a schematic diagram of the refrigerant circuit of the air conditioning system for multiple rooms according to the second embodiment. In the second embodiment, an outdoor unit 1 includes a high pressure detector 38 and a low pressure detector 39, from which detection signals are inputted into a controller 15 as shown. The controller 15 controls compressor 2, and a four way reversing valve 3, and the heat exchange capability of an outdoor heat exchanger 4 through a fan 9. Reference numeral 7 designates an accumulator.

In the refrigerant circuit, the high pressure detector 38 is arranged at a high pressure pipe in the outdoor unit 1, and the low pressure detector 39 is arranged at a low pressure pipe in the outdoor unit 1. The controller 15 receives signals from both detectors 38 and 39 to carry out the delivery control for the compressor 2, to control the heat exchange capability of the outdoor heat exchanger 4 through revolution control of the fan 9, and to perform the switching control of the four way reversing valve 3 by performing operations as to whether the indoor heat exchanger 4 is operated as a condenser to be used for a radiating source, or is operated as an evaporator to be used for a heat absorbing source.

In general, if the capability of the compressor 2 is increased, a high pressure Pd raises, and a low pressure Ps lowers. If the capability of the evaporator is increased, both high pressure Pd and low pressure Ps raise. To the contrary, if the capability of the condenser is increased, both high pressure Pd and low pressure Ps lowers. The relationship among them can be quantified to obtain the following equation:

$$\begin{pmatrix} \Delta Pd \\ \Delta Ps \end{pmatrix} = \begin{pmatrix} a & b \\ -c & d \end{pmatrix} \begin{pmatrix} \Delta Q_{comp} \\ \Delta Ake \end{pmatrix}$$

wherein a,b,c,d>0, ΔPd=Pd*−Pd, ΔPs=Ps*−Ps (Pd* and Ps* are desired values, and Pd and Ps are detected values.), $\Delta Q_{comp}$ is a capability variable of the compressor 2, and ΔAke is a heat exchange capability variable of the outdoor heat exchanger. The equation can be modified as:

$$\begin{pmatrix} \Delta Q_{comp} \\ \Delta Ake \end{pmatrix} = \frac{1}{ad+bc}\begin{pmatrix} d & -b \\ c & d \end{pmatrix}\begin{pmatrix} \Delta Pd \\ \Delta Ps \end{pmatrix} = \begin{pmatrix} A & B \\ C & D \end{pmatrix}\begin{pmatrix} \Delta Pd \\ \Delta Ps \end{pmatrix}$$

Figure 4:
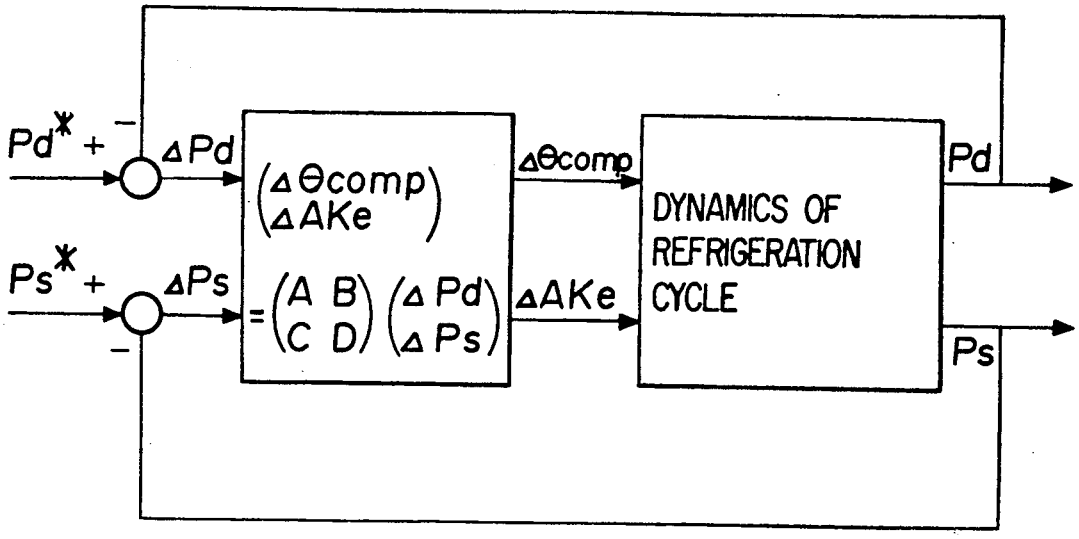
FIG. 4 is a control block diagram of the second embodiment.

Referring now to FIG. 4, there is shown a schematic control block diagram wherein the equation is represented in the form of diagram. The controller 15 carries out the controls of respective parts based on the result of the operations.

A condensing temperature CT and an evaporating temperature ET may be utilized instead of the high pressure Pd and the low pressure Ps. At that case, sensors for detecting the condensing temperature and the evaporating temperature are required. The equation at that case is as follows:

$$\begin{pmatrix} \Delta Q_{comp} \\ \Delta Ake \end{pmatrix} = \begin{pmatrix} A' & B' \\ C' & D' \end{pmatrix}\begin{pmatrix} \Delta CT \\ \Delta ET \end{pmatrix}$$

wherein, $\Delta CT = CT^* - CT$, $\Delta ET = ET^* - ET$, $CT^*$ and $ET^*$ are desired values, and CT and ET are detected values.

In accordance with the second embodiment, the pressures at the high pressure pipe and the low pressure pipe in the outdoor unit, or the condensing temperature and the evaporating temperature in the outdoor unit are detected, and the compressor capability variable and the heat exchange capability variable of the outdoor heat exchanger are calculated based on the controlled deviation between the detected values and the desired values. Based on the result of the calculation, the delivery control of the compressor in the outdoor unit, the control for the heat exchange capability of the outdoor heat exchanger, and the switching control of the four way reversing valve are carried out.

As explained, in accordance with the second embodiment, in the air conditioning system which has a cooling and heating concurrent multiple refrigerant circuit using two pipes, the controls for the outdoor compressor and the outdoor heat exchanger can be carried out based on only the temperature or the pressure detected in the outdoor unit. No information about the indoor units is required to enable an autonomous decentrialized controls for the indoor units and the outdoor unit, improving reliability and stabilizing operation performance.

Now, a third embodiment of the present invention will be described.

Figure 5:
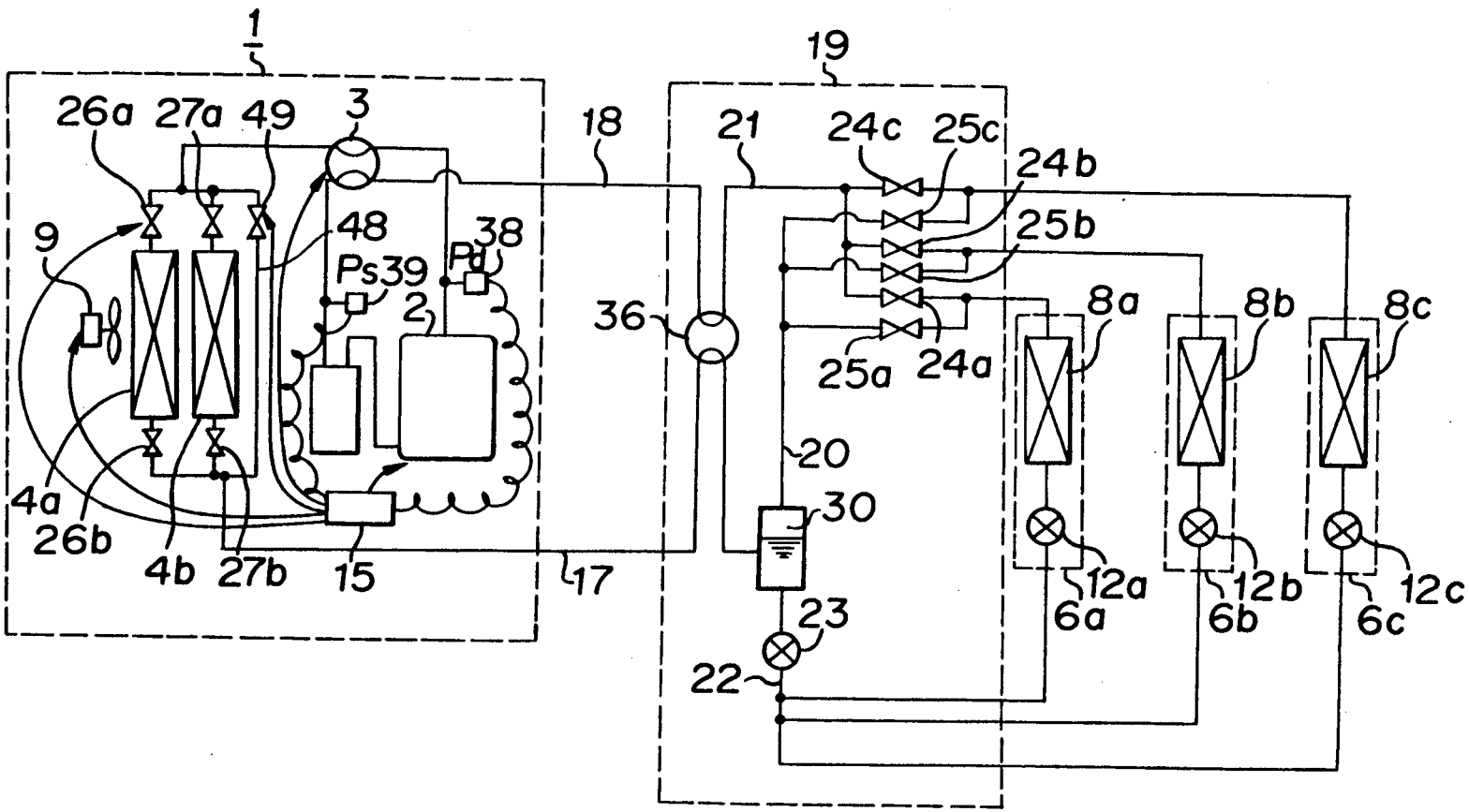
FIG. 5 is a schematic diagram of a third embodiment.

Referring now to FIG. 5, there is shown a schematic diagram showing the refrigerant circuit of the air conditioning system according to the third embodiment. In the third embodiment, on-off valves 26a, 26b, 27a and 27b, a bypass passage 48 and a bypass on-off valve 49 are arranged in an outdoor unit 1 as shown.

The on-off valves 26a, 26b, 27a and 27b are connected to both ends of outdoor hear exchangers 4a and 4b, the bypass passage 48 is arranged in parallel with the outdoor hear exchangers 4a and 4b, and the bypass on-off valve 49 is arranged in the bypass passage 48.

In addition, the reference numeral 38 designates a high pressure detector which is arranged at the refrigerant outlet side of a variable delivery compressor 2 to detect the pressure Pd of the refrigerant at that location. Reference numeral 39 designates a low pressure detector which is arranged at the refrigerant inlet side of an accumulator 7 to detect the pressure Ps of the refrigerant at that location. Reference numeral 15 designates a controller which controls a four way reversing valve 3, an outdoor fan 9, the on-off valves 26a, 26b, 27a and 27b, and the bypass on-off valve 49 based on the detection outputs from the high pressure detector 38 and the low pressure detector 39. Reference numeral 36 designates a four way reversing valve.

In the air conditioning system of the third embodiment, when an indoor unit 6a is under heating mode and outdoor units are under cooling mode, a heat exchanger 8a of the indoor unit 6a works as condenser and heat exchangers 8b and 8c of the indoor units 6b and 6c function as evaporator.

In the operation of the third embodiment, the heat exchange capability required for the outdoor unit 1 changes depending on a change in the capability of the indoor units 6a–6c, or the switching from the heating mode to the cooling mode and vice versa in the indoor units. This means that the heat exchange capability of the outdoor unit 1 has to be controlled accordingly. In the third embodiment, a signal indicative of the high pressure Pd detected by the high pressure detector 38, and a signal indicative of the low pressure Ps detected by the low pressure detector 39 are transmitted to the controller 15. In general, if the compressor capability is increased, the high pressure Pd raises, and the low pressure Ps lowers. On the other hand, if the evaporation capability is increased, both high pressure Pd and low pressure Ps raise. To the contrary, if the condenser capability is increased, both high pressure Pd and low pressure Ps lower. If there is such a steady state that the high pressure Pd and the low pressure Ps keep certain values, it can be considered that the hear exchange capability of the indoor units is balanced against that of the outdoor unit. This means that if the heat exchange capability of the outdoor unit 1 is controlled in a way to bring the high pressure Pd and the low pressure Ps closer to a predetermined desired high pressure Pd* and a predetermined desired low pressure Ps*, respectively, an autonomous control can be realized in the outdoor unit 1 in a closed form. If a variable for the compressor capability $Q_{comp}$ is represented by $\Delta Q_{comp}$, and if a variable for the heat exchange capability $Ak_0$ of the outdoor hear exchanger is represented by $\Delta Ak_0$, the relationship between Pd and Ps is expressed as the following equation (2):

$$\begin{pmatrix} \Delta Pd \\ \Delta Ps \end{pmatrix} = \begin{pmatrix} a & b \\ -c & d \end{pmatrix}\begin{pmatrix} \Delta Q_{comp} \\ \Delta AK_0 \end{pmatrix} \quad (2)$$

$$a, b, c, d > 0$$

wherein a, b, c and d are predetermined constants, and $\Delta Pd$ and $\Delta Ps$ are controlled deviations to the desired values, despectively, i.e.

$$\Delta Pd = Pd^* - Pd, \ \Delta Ps = Ps^* - Ps.$$

The equation (2) can be modified as follows:

$$\begin{pmatrix} \Delta Q_{comp} \\ \Delta AK_0 \end{pmatrix} = \frac{1}{ad + bc} \begin{pmatrix} d & -b \\ c & a \end{pmatrix} \begin{pmatrix} \Delta Pd \\ \Delta Ps \end{pmatrix} = \begin{pmatrix} A & B \\ C & D \end{pmatrix} \begin{pmatrix} \Delta Pd \\ \Delta Ps \end{pmatrix} \quad (3)$$

Figure 6:
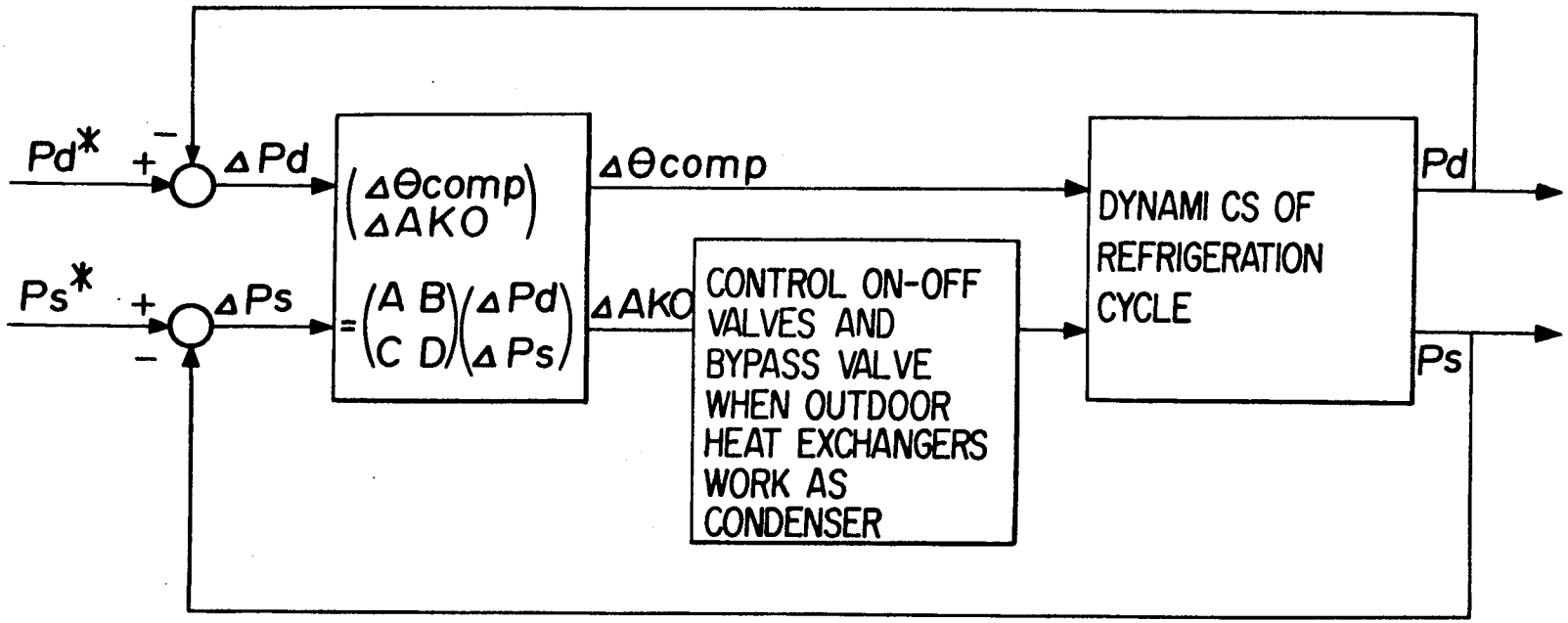
FIG. 6 is a control block diagram of the third embodiment.

Based on $\Delta Q_{comp}$ thus found, the delivery control of the compressor 2 is carried out. In addition, based on $\Delta Q_{comp}$ thus found, it is determined whether the outdoor heat exchangers 4a and 4b are operated as condensers to be used for radiating source or are operated as evaporators to be used for hear absorbing source. Based on the result of this determination, four way reversing valves 3 and 36 are controlled. For example, under the operation states as stated earlier, if the heat exchange capability obtained by the previous heat exchange capability and the newly found heat exchange capability is positive, the refrigerant circuit takes such cycle that the outdoor heat exchangers 4a and 4b work as evaporators. If the heat exchange capability thus obtained is negative, the refrigerant circuit takes such cycle that the outdoor heat exchangers 4a and 4b work as condensers. Variable control for the heat exchange capability at these cycles (AKe for positive, and AKc for negative) is made by controlling the revolutions of the outdoor fan 9 and carrying out the on-off control of the on-off valves 26a, 26b, 27a and 27b, and the bypass valve 49. In other words, depending on the found heat exchange capability, the selection of the outdoor heat exchangers to be activated is made, and whether bypassing the refrigerant through the bypass passage 48 is required or not is determined. In addition, the revolution of the outdoor fan 9 is adjusted to continuously control the heat exchange capability. Referring now to FIG. 6, there is shown a schematic control block diagram showing such control.

Figure 7:
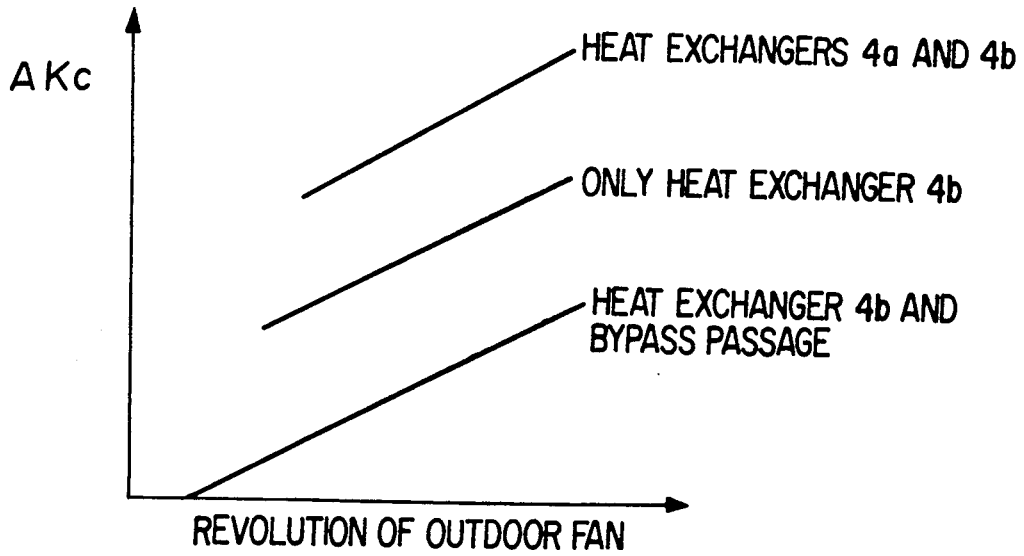
FIG. 7 is a drawing of graphs to help explain the operation control of the third embodiment.

For example, if the outdoor heat exchangers 4a and 4b work as condensers, whether to use both outdoor heat exchangers 4a and 4b or to use only the outdoor heat exchanger 4b, and whether to use the outdoor heat exchanger(s) while bypassing a part of the refrigerant through the bypass passage 48 are determined depending on a required heat exchange capability. According to such determination, the on-off controls of the on-off valves 26a, 26b, 27a and 27b, and the bypass valve 49 are made, and the revolution of the outdoor fan 9 is controlled. Referring now to FIG. 7, there is shown the relationship between the revolution of the outdoor fan and the heat exchange capability of the condenser(s) at the respective cases. The case wherein both outdoor heat exchangers 4a and 4b are used has the greatest value for AKc, with the case wherein only the outdoor heat exchanger 4b is used, and the case wherein the bypass passage 48 is used for bypass following in that order. In addition, the values for AKc successfully change with respect to the revolutions of the outdoor fan 9 in the respective cases.

Such controls can be adopted to realize an autonomous capability control in the outdoor unit 1.

Figure 8:
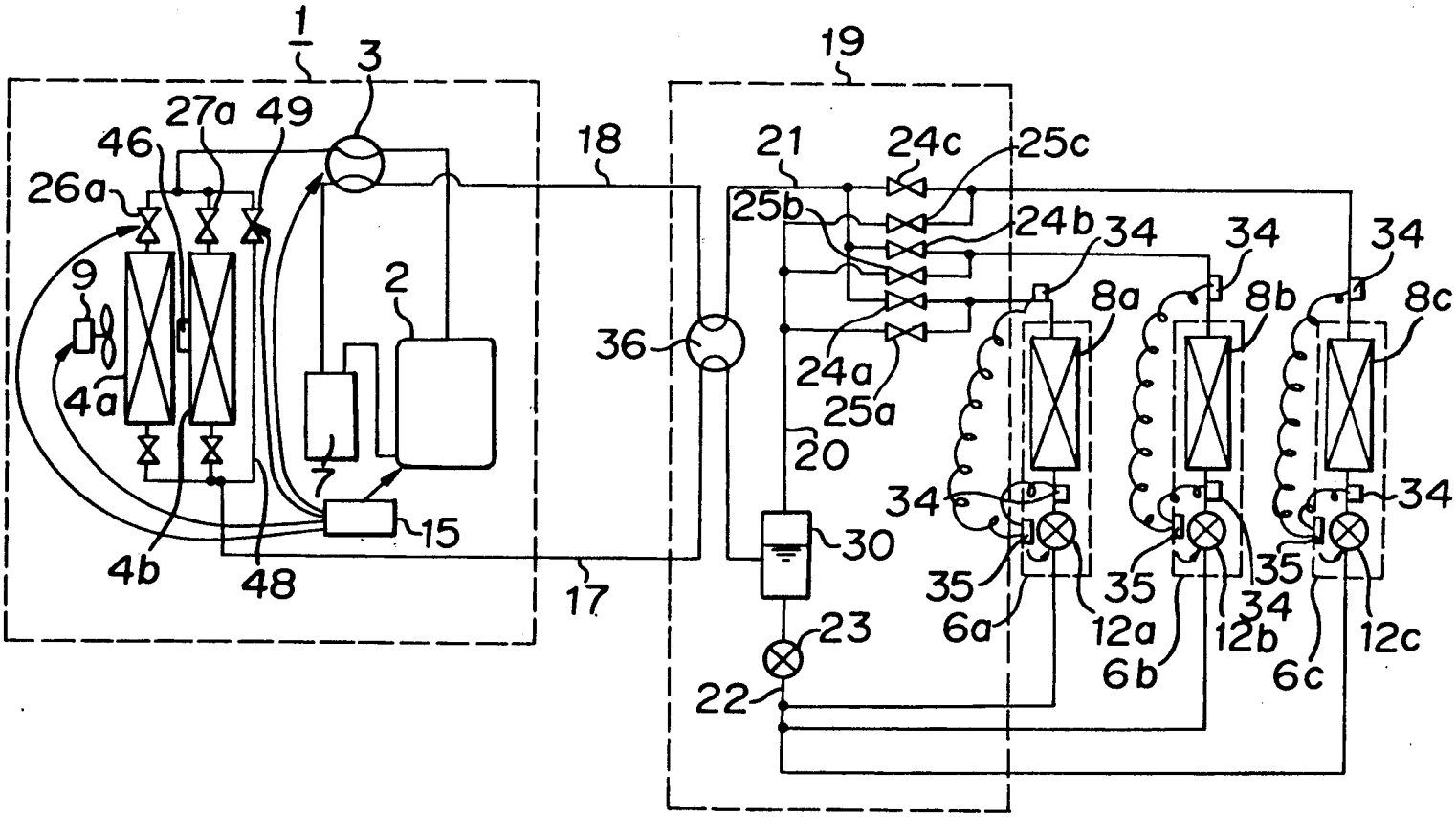
FIG. 8 is as schematic diagram of the air conditioning system of a fourth embodiment.

Referring now to FIG. 8, there is shown a schematic diagram of the air conditioning system of a fourth embodiment wherein a refrigerant condensing temperature CT and a refrigerant evaporating temperature ET in the whole system are detected instead of the high pressure Pd and the low pressure Ps to control the outdoor unit 1. Reference numeral 34 designates refrigerant temperature sensors which are arranged in indoor units 6a–6c, respectively.

Reference numeral 35 designates microcomputers which control electronic expansion valves 12a–12c based on temperatures detected by the refrigerant temperature sensors 34 to carry out autonomous controls of the indoor units 6a–6c. Reference numeral 46 designates a temperature sensor which is arranged on an outdoor hear exchanger 4b. In this embodiment, the greatest value among the temperatures detected by the refrigerant temperature sensors 34 and the temperature sensor 46 is taken as the condensensing temperature CT, and the least value is taken as the evaporating temperature ET. A controlled deviation ΔCT between the condensensing temperature CT and a desired condensensing temperature CT*, and a controlled deviation ΔET between the evaporating temperature ET and a desired evaporating temperature ET* are found, respectively. Like the control based on the high pressure Pd and the low pressure Ps, $\Delta Q_{comp}$ and $\Delta AK_0$ are found from the following equation:

$$\begin{pmatrix} \Delta Q_{comp} \\ \Delta AK_0 \end{pmatrix} = \frac{1}{a'd' + b'c'} \begin{pmatrix} d' & -b' \\ c' & a' \end{pmatrix} \begin{pmatrix} \Delta CT \\ \Delta ET \end{pmatrix} \quad (4)$$

The heat exchange capability may be controlled in a similar manner. Although in that case there is e.g. a manner wherein the highest temperature and the lowest temperature are selected by the microcomputers 35 or the like in the indoor units, and these temperatures are transmitted to the outdoor unit to be compared to the detection temperature in the outdoor unit, at least one signal transmission line is required between the indoor units and the outdoor unit. However, the provision of the temperature sensors offers advantage over that of the pressure detectors in terms of cost.

The air conditioning system according to the third embodiment collects the high pressure Pd and the low pressure Ps by the pressure sensors in the form of real time measurement, and calculates the controlled deviation ΔPd and ΔPs to the desired high pressure Pd* and the desired low pressure Ps* in the refrigeration cycle. In addition, the system finds a product by multiplying the constant matrix $$\begin{pmatrix} A & B \\ C & D \end{pmatrix},$$

and takes the calculation result as $$\begin{pmatrix} \Delta Q_{comp} \\ \Delta Ak_0 \end{pmatrix}.$$

Based on such result, the heat exchange capability of the outdoor heat exchangers is controlled.

As explained, the third embodiment has such arrangement that the controls of the compressor, the outdoor heat exchangers and the four way reversing valve in the outdoor unit are made based on detection on only the high pressure and the low pressure in the outdoor unit. This arrangement enables the autonomous decentralized controls in the indoor units and the outdoor unit, offering an advantage in that reliability is improved and operation performance is stabilized.

Like the fourth embodiment, the condensensing temperature and the evaporating temperature, instead of the high pressure and the low pressure, in the refrigerant cycle may be detected for the autonomous decentralized controls to stabilize the operation of the outdoor unit.

Now, a fifth and a sixth embodiment of the present invention will be described.

Figure 9:
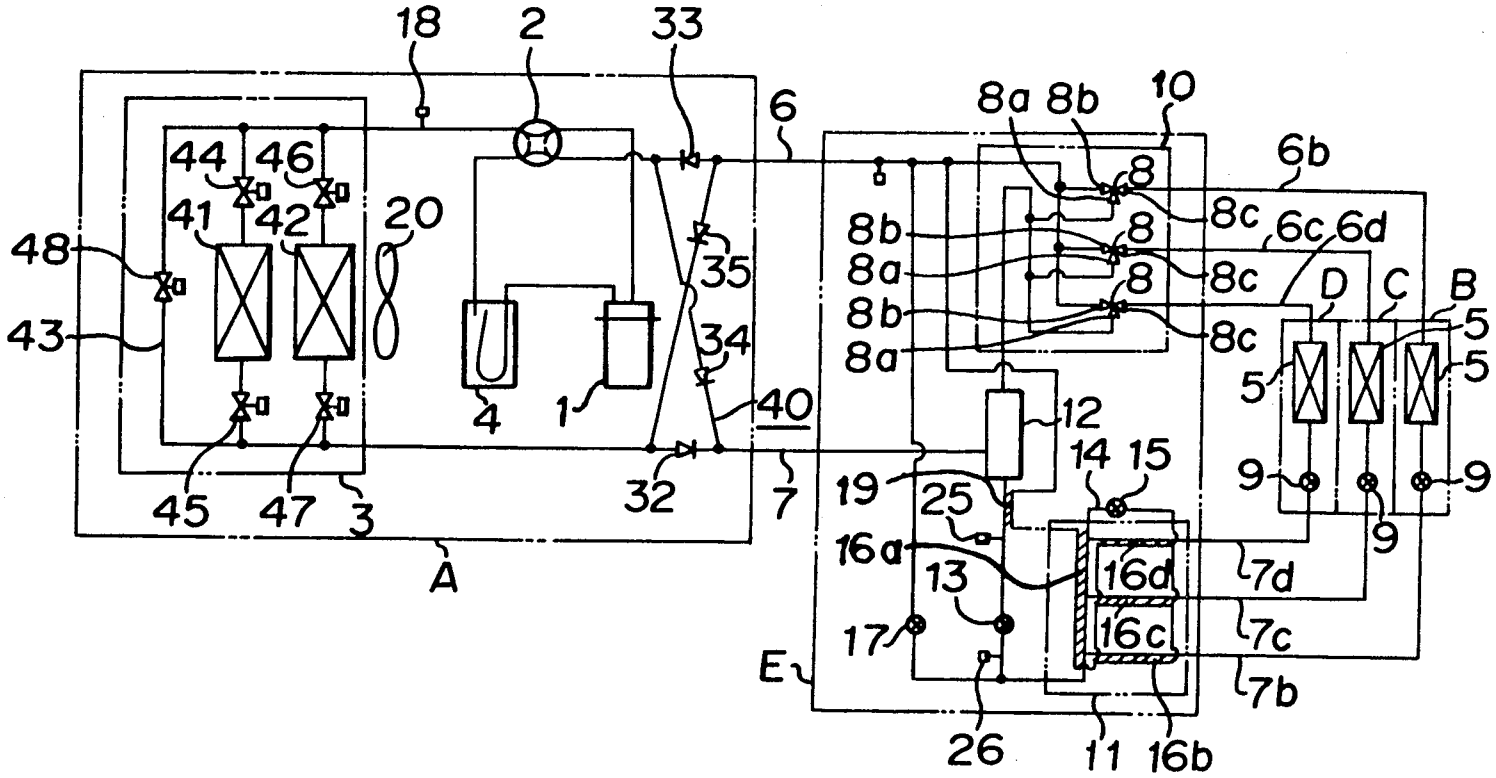
FIG. 9 is a schematic diagram of the air conditioning system of a fifth embodiment.
Figure 10:
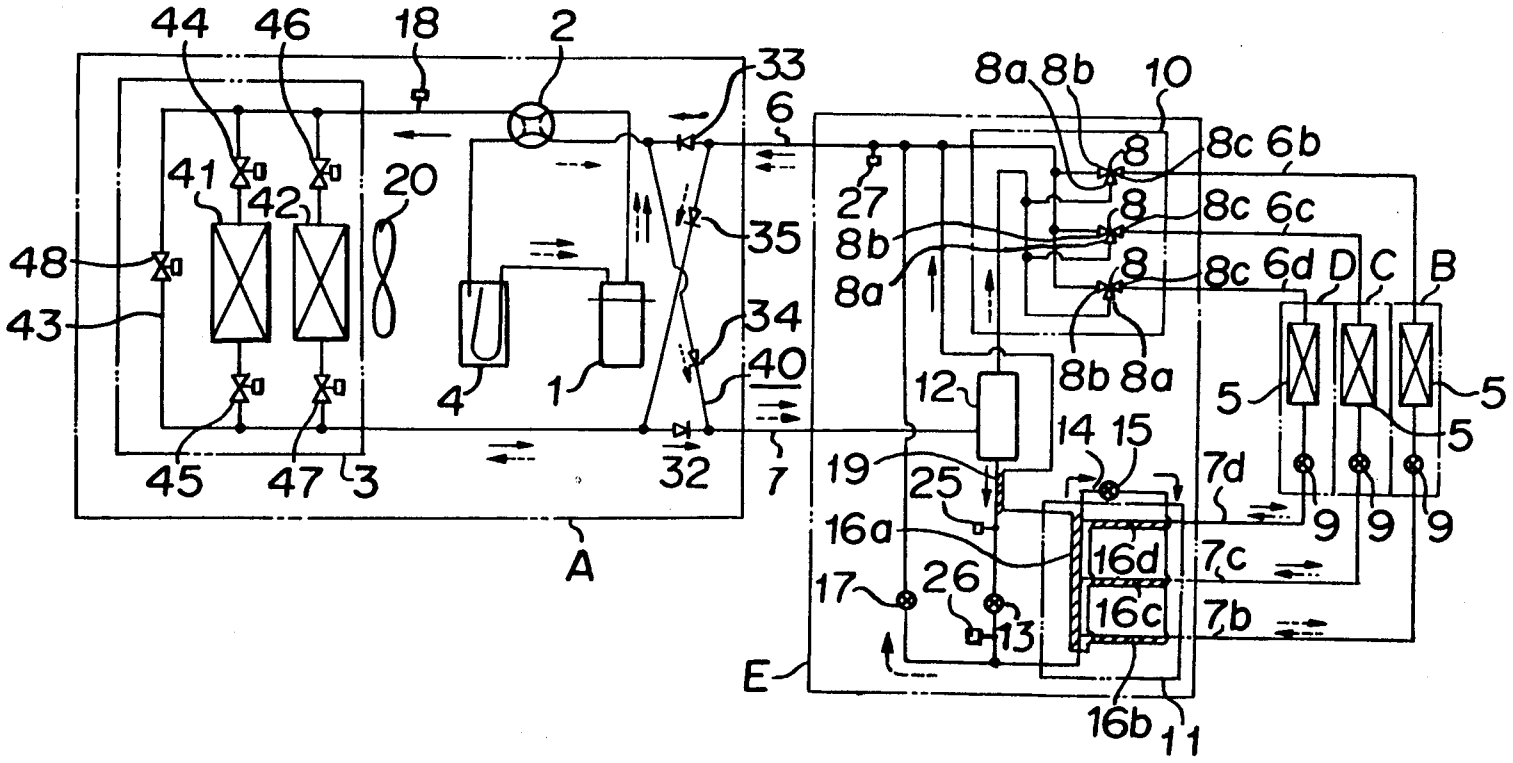
FIG. 10 is a schematic diagram showing the operation states of the fifth embodiment of FIG. 9 wherein sole operation on cooling and sole operation on heating are performed.
Figure 11:
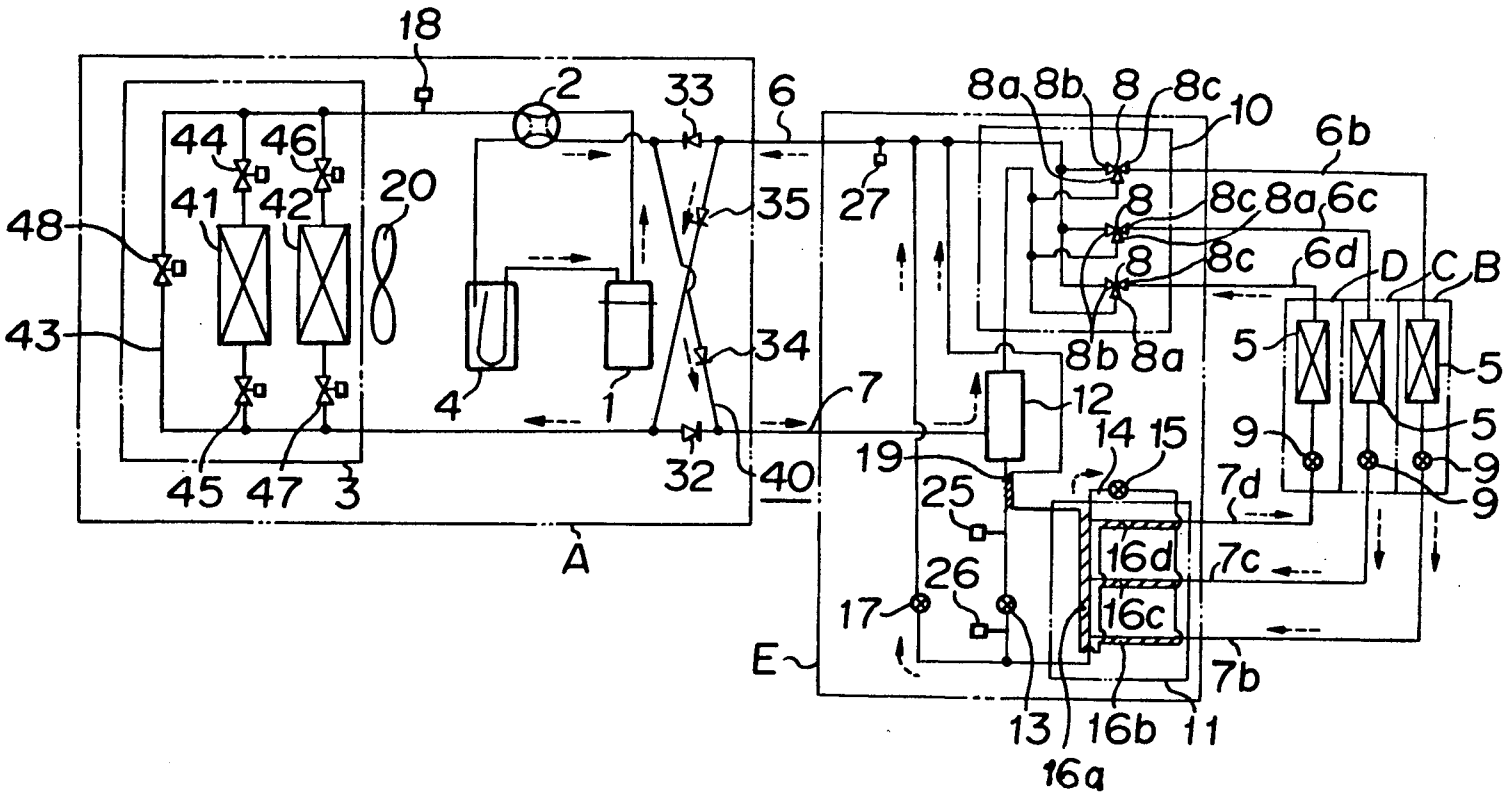
FIG. 11 is a schematic diagram showing the operation states of the fifth embodiment of FIG. 9 wherein heating is principally performed when heating load is greater than cooling load.
Figure 12:
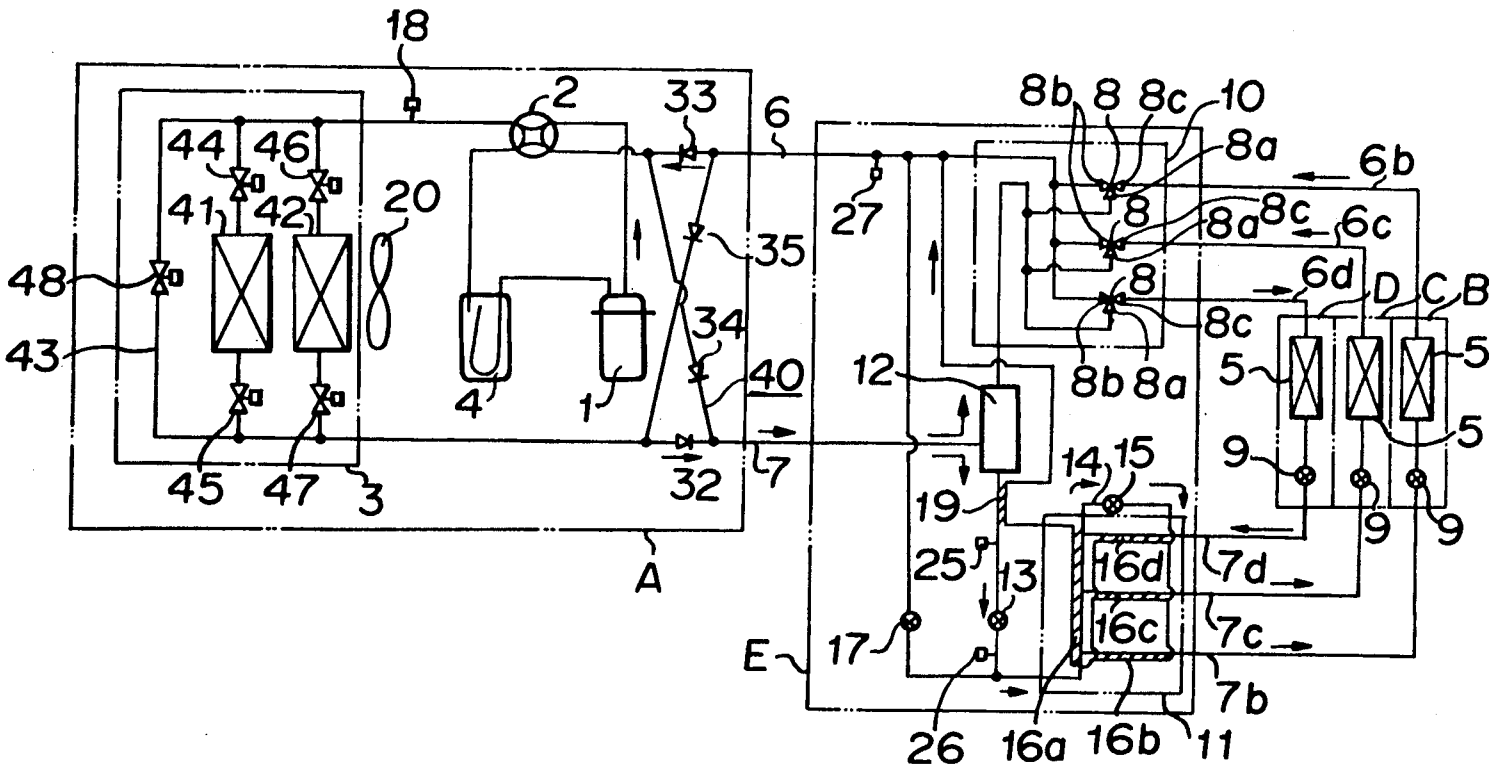
FIG. 12 is a schematic diagram showing the operation states of the fifth embodiment of FIG. 9 wherein cooling is principally performed when cooling load is greater than heating load.
Figure 13:
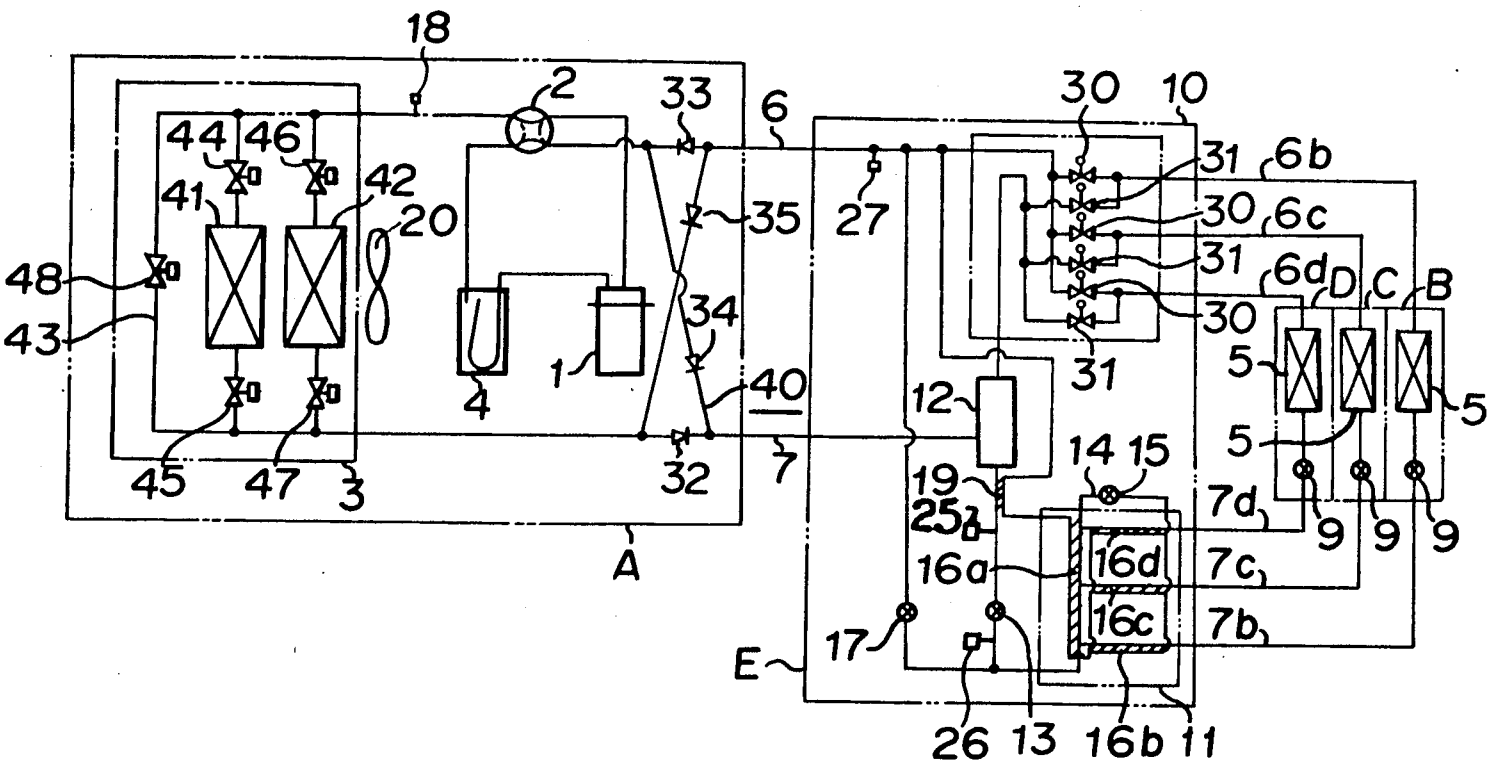
FIG. 13 is a schematic diagram showing the air conditioning system of a sixth embodiment.

Referring now to FIG. 9, there is shown a schematic diagram of the entire structure of the fifth embodiment of the air conditioning system according to the present invention, which is depicted on the bases of the refrigerant system of the air conditioning system. Referring to FIGS. 10 through 12, there are shown schematic diagrams showing the operation states under the cooling and heating modes according to the fifth embodiment of FIG. 9, FIG. 10 showing the operation states wherein sole operation on cooling and sole operation on heating are performed, FIGS. 11 and 12 showing the operation states of a cooling and heating concurrent operation, FIG. 11 showing the operation states wherein heating is principally performed (heating load is greater than cooling load), and FIG. 12 showing the operation state wherein cooling is principally performed (cooling load is greater than heating load). Referring now to FIG. 13, there is shown a schematic diagram showing the entire structure of a sixth embodiment of the air conditioning system which is depicted on the bases of the refrigerant system of the air conditioning system. Although explanation on these embodiments will be made for the case wherein a single heat source device is connected to three indoor units, the following explanation is also applicable to the case wherein a single source device is connected two or more indoor units.

In FIG. 9, reference numeral A designates the heat source device. Reference numerals B, C and D designate the indoor units which are connected in parallel with one another as described later on, and which have the same structures. Reference numeral E designates a junction device which includes a first branch joint 10, a second flow controller 13, a second branch joint 11, a gas-liquid separator 12, heat exchanging portions 16*a*, 16*b*, 16*c*, 16*d* and 19, a third flow controller 15, and a fourth flow controller 17.

Reference numeral 1 designates a compressor. Reference numeral 2 designates a four way reversing valve which can switch the flow direction of a refrigerant in the heat source device. Reference numeral 3 designates an outdoor heat exchange unit which is installed in the heat source device. Reference numeral 4 designates an accumulator which is connected to the compressor 1, the reversing valve 2 and the outdoor heat exchange unit 3. Reference numeral 20 designates a variable air volume type of outdoor fan which is installed in the heat source device to feed air to the outdoor heat exchange unit 3. The heat source device A is constituted by these members. Reference numeral 5 designates indoor heat exchangers which are arranged in the three indoor unit B, C and D. Reference numeral 6 designates a first connecting pipe which is large in diameter, and which connects the four way reversing valve 2 in the heat source device A to the junction device E. Reference numerals 6*b*, 6*c* and 6*d* designate first branch pipes which connect the indoor heat exchangers 5 in the indoor units B, C and D to the junction device E, respectively, and which correspond to the first main connecting pipe 6. Reference numeral 7 designates a second main connecting pipe which connects the outdoor exchange unit 3 in the heat source device A to the junction device E, and which is smaller than the first main connecting pipe in diameter. Reference numerals 7*b*, 7*c* and 7*d* designate second branch pipes which connect the indoor heat exchangers 5 in the indoor units B, C and D to the junction device E, respectively, and which are arranged at the side of the indoor units to correspond to the second main pipe 7. Reference numeral 8 designates three way switching valves which can selectively connect the first branch pipes 6*b*, 6*c* and 6*d* to either the first main pipe 6 or the second main pipe 7. Reference numeral 9 designates first flow controllers which are connected to the respective indoor heat exchangers 5 in close proximity to the same, which are controlled based on superheat amounts on cooling and sub-cooling amounts on heating at outlet sides of the respective indoor heat exchangers 5, and which are connected to the second branch pipes 7*b*, 7*c* and 7*d*, respectively. Reference numeral 10 designate the first branch joint which is constituted by the three way switching valves 8 which can selectively the first branch pipes 6*b*, 6*c* and 6*d* to either the first main pipe 6 or the second main pipe 7. Reference numeral 11 designates the second branch joint which includes the second branch pipes 7*b*, 7*c* and 7*d* for the indoor units, and the second main pipe 7. Reference numeral 12 designates the gas-liquid separator which is arranged in the second main pipe 7, and which has a gas layer zone connected to first ports 8*a* of the respective switching valves 8 and a liquid layer zone connected to the second branch joint 11. Reference numeral 13 designates the second flow controller (an electric expansion valve in the embodiment) which is connected between the gas-liquid separator 12 and the second branch joint 11, and which can be selectively opened and closed. Reference numeral 14 designates a bypass pipe which connects the second branch joint 11 to the first main pipe 6. Reference numeral 15 designates the third flow controller (an electric expansion valve in the embodiment) which is arranged in the bypass pipe 14. Reference numeral 16*a* designates the second heat exchanging portion which is arranged in the bypass pipe 14 downstreams of the third flow controller 15, and which carries out heat exchange with the confluence of the second branch pipes 7*b*, 7*c* and 7*d* for the indoor units in the second branch joint 11. Reference numerals 16*b*, 16*c* and 16*d* designate the third heat exchanging portions which are arranged downstream of the third flow controller 15 in the bypass pipe 14, and which carries out heat exchange with the second branch pipes 7*b*, 7*c* and 7*d* for the indoor units in the second branch joint 11. Reference numeral 19 designates the first heat exchanging portion which is arranged downstream of the third flow controller 15 in the bypass pipe 14 and downstream of the second heat exchanging portion 16*a*, and which carries out heat exchange with a pipe connecting between the gas-liquid separator 12 and the second flow controller 13. Reference numeral 17 designates the fourth flow controller (an electric expansion valve in the embodiment) which connects between the second branch joint 11 and the first main pipe 6 so as to be selectively opened and closed. Reference numeral 32 designates a third check valve which is arranged between the outdoor exchange unit 3 and the second main pipe 7, and which allows the refrigerant only to flow from the outdoor exchange unit 3 to the second main pipe 7. Reference numeral 33 designates a fourth check valve which is arranged between the four way reversing valve 2 in the heat source device A and the first main pipe 6, and which allows the refrigerant only to flow from the first main pipe 6 to the four way reversing valve 2. Reference numeral 34 designates a fifth check valve which is arranged between the four way reversing valve 2 in the heat source device A and the second main connecting pipe 7, and which allows the refrigerant only to flow from the four way reversing valve 2 to the second main connecting pipe 7. Reference numeral 35 designates a sixth check valve which is arranged between the outdoor exchange unit 3 and the first main connecting pipe 6, and which the refrigerant only to flow from the first main connecting pipe 6 to the outdoor exchange unit 3. The third, the fourth, the fifth and the sixth check valves 32, 33, 34 and 35 form a check valve unit 40. Reference numeral 25 designates a first pressure detecting means which is arranged between the first branch joint 10 and the second flow controller 13. Reference numeral 26 designates a second detecting means which is arranged between the second flow controller 13 and the fourth flow controller 17.

The outdoor heat exchange unit 3 is constituted by a first outdoor heat exchanger 41, a second outdoor heat exchanger 42 connected in parallel with the first outdoor heat exchanger 41 and having the same heating surface area as the first outdoor heat exchanger 41, a heat source device bypass passage 43, a first electromagnetic on-off valve 44 arranged at one end of the first outdoor heat exchanger 41 for connection with the four way reversing valve 2, a second electromagnetic on-off valve 45 arranged at the other end of the first outdoor heat exchanger 41, a third electromagnetic on-off valve 46 arranged at one end of the second outdoor heat exchanger 42 for connection with the four way reversing valve 2, a fourth electromagnetic on-off valve 47 arranged at the other end of the second outdoor heat exchanger 42, and a fifth electromagnetic on-off valve 48 arranged in the heat source device bypass passage 43. Reference numeral 18 designates a fourth pressure detecting means which is arranged in a pipe which connects between the four way reversing valve 2 and the outdoor heat exchange unit 3. The pipe is under high pressure on cooling mode and under low pressure on heating mode.

The operation of the fifth embodiment will be described. Firstly, the operation in a sole cooling mode will be explained, referring to FIG. 10.

As indicated by arrows of solid line in FIG. 10, the refrigerant which has been discharged from the compressor 1 to become a gas having high temperature and high pressure passes through the four way reversing valve 2, and carries out heat exchange with the air fed by the variable air volume type outdoor fan 20 at the outdoor heat exchange unit 3, where the refrigerant is condensed to be liquefied. After that, the refrigerant thus liquefied passed through the third check valve 32, the second main connecting pipe 7, the gas-liquid separator 12 and the second flow controller 13 in that order, and enters the respective indoor units B, C and D through the second branch joint 11 and the second branch pipes **7*b*, 7*c* and 7*d* for the indoor units. The refrigerant which has entered the indoor units B, C and D is depressurized by the flow controllers 9 which are controlled based on the superheat amounts at the outlets of the respective indoor heat exchangers 5. The refrigerant which has been depressurized to have low pressure by the flow controllers 9 carries out heat exchange, at the indoor heat exchangers 5, with the air in the room with the corresponding heat exchangers therein. As a result of the heat exchange, the refrigerant is evaporated and gasified, causing the rooms to be cooled. The refrigerant thus gasified passes through the first branch pipes 6*b*, 6*c* and 6*d* for the indoor units, the three way switching valves 8, the first branch joint 10, the first main connecting pipe 6, the fourth check valve 33, the four way reversing valve 2 in the heat source device, and the accumulator 4, and is inspired into the compressor 1. In this manner, a circulation cycle is formed to carry out cooling. At that time, the three way switching valves 8 have the first ports 8*a* closed, and second ports 8*b* and third ports 8*c* opened. At that time, the first main connecting pipe 6 is at low pressure in it, and the second main connecting pipe 7 is at high pressure in it, which necessarily make the third check valve 32 and the fourth check valve 33** to conduct.

In addition, in this mode, the refrigerant which has passed through the second flow controller 13 partly enters the bypass pipe 14 where the entered part of the refrigerant is depressurized to low pressure by the third flow controller 15. The refrigerant thus depressurized carries out heat exchange with the second branch pipes **7*b*, 7*c* and 7*d* at the third heat exchanging portions 16*b*, 16*c* and 16*d* in the second branch joint 11, with the confluence of the second branch pipes 7*b*, 7*c* and 7*d* for the indoor units at the second heat exchanging portion 16*a* in the second branch joint 11 and at the first heat exchanging portion 19 with the refrigerant which will enter the second flow controller 13. The refrigerant is evaporated due to such heat exchange, passes through the first main connecting pipe 6 and the fourth check valve 33, and is inspired into the compressor 1 through the outdoor four way reversing valve 2 and the accumulator 4. On the other hand, the refrigerant, which has heat exchanged at the first, the second and the third heat exchanging portions 19, 16*a*, 16*b*, 16*c* and 16*d*, and has been cooled so as to get sufficient sub-cooling in the second branch joint 11**, enters the indoor units B, C and D which are expected to carry out cooling.

The operation in a sole heating mode will be explained, referring to FIG. 10. As indicated in by arrows of dotted line, the refrigerant which bas been discharged from the compressor 1 to become a gas having high temperature and high pressure passes through the four way reversing valve 2, passes through the fifth check valve 34, the second main connecting pipe 7 and the gas-liquid separator 12, and passes through the first branch joint 10, the three way switching valves 8, the first branch pipes **6*b*, 6*c* and 6*d* for the indoor units in that order. Then, the refrigerant enters the respective indoor units B, C and D where carries out heat exchange with the air in the rooms to be condensed and liquefied, causing the rooms to be heated. The refrigerant thus liquefied passes through the first flow controllers 9 which are controlled to be substantially fully opened based on sub-cooling amounts at the outlets of the respective indoor heat exchangers 5. Then, the refrigerant enters the second branch joint 11 through the second branch pipes 7*b*, 7*c* and 7*d* for the indoor units, and joins together. In addition, the joined refrigerant passes through the fourth flow controller 17. The refrigerant is depressurized by either the first flow controller 9, or the third and the fourth flow controllers 13 and 17 to take a two phase state having low pressure. The refrigerant thus depressurized passes through the first main connecting pipe 6 and the sixth check valve 35** in the heat source device A, and enters the outdoor heat exchange unit 3, where the refrigerant carries out heat exchange with the air fed by the variable air volume type of outdoor fan 20. The refrigerant which has been evaporated and gasified due to such heat exchange is inspired into the compressor 1 through the four way reversing valve 2 in the heat source device, and the accumulator 4. In that manner, a circulation cycle is formed to carry out heating. At that mode, the three way switching valves 8 have the second ports 8*b* closed, and the first ports 8*a* and the third ports 8*c* opened. At that time, the first main connecting pipe 6 is at low pressure in it, and the second main connecting pipe 7 is at high pressure in it, which necessarily allows the refrigerant to flow through the fifth check valve 34 and the sixth check valve 35.

Thirdly, the case wherein heating is principally performed in cooling and heating concurrent operation will be explained, referring to FIG. 11.

As indicated by arrows of dotted line, the refrigerant which has been discharged from the compressor 1 to become a gas having high temperature and high pressure is forwarded to the junction device E through the fifth check valve 34 and the second main connecting pipe 7. The refrigerant passes through the gas-liquid separator 12, passes through the first branch joint 10, the three way switching valves 8 and the first branch pipes 6*b* and 6*c* for the indoor units in that order, and enters the respective indoor units B and C which are expected to carry out heating. The refrigerant carries out heat exchange, at the indoor heat exchangers 5, with the air in the room with the indoor units B and C therein, and is condensed and liquefied to heat the rooms. The refrigerant thus condensed and liquefied passes through the first flow controllers 9 which are controlled to be substantially fully opened based on sub-cooling amounts at the outlets of the indoor heat exchangers of the indoor units B and C, is slightly depressurized by the first flow controllers 9, and enters the second branch joint 11. The refrigerant which has entered the second branch joint 11 partly passes through the second branch pipe 7*d* and enters the indoor unit D which is expected to carry out cooling. The refrigerant enters the first flow controller 9 which is controlled based on superheat amount at the outlet of the indoor heat exchanger of the indoor unit D, and is depressurized therein. After that, the refrigerant thus depressurized enters the indoor heat exchanger 5, and carries out heat exchange to be evaporated and gasified, causing the room to be cooled. Then, The refrigerant goes into the first main connecting pipe 6 through the three way switching valve 8.

On the other hand, the remaining refrigerant passes through the fourth flow controller 17 which is controlled in a way to bring the pressure difference between the detected pressure by the first pressure detecting means 25 and that by the second pressure detecting means 26 into a predetermined range. That refrigerant joins with the refrigerant which has passed through the cooling indoor unit D, passes through the first main connecting pipe 6 and the sixth check valve 35 in the heat source device A, and enters the outdoor heat exchange unit 3 where the refrigerant carries out heat exchange with the air fed by the outdoor fan 20. The refrigerant is evaporated and gasified due to such heat exchange. The heat exchange amount can be arbitrarily obtained at the outdoor heat exchange unit 3 by adjusting the air volume from the outdoor fan 20 in a way to bring the detected pressure by the fourth pressure detecting means 18 to a predetermined desire pressure, carrying out the on-off controls of the first, the second, the third and the fourth electromagnetic on-off valve 44, 45, 46 and 47 at the opposite ends of the first and the second outdoor heat exchangers 41 and 42 to adjust heating surface area, and carrying out the on-off control of the electromagnetic on-off valve 48 in the heat source device bypass passage 43 to adjust the flow rate of the refrigerant which can pass through the first and the second outdoor heat exchangers 41 and 42. The refrigerant is inspired into the compressor 1 through the four way reversing valve 2 in the heat source device and the accumulator 4. In that manner, a circulation cycle is formed to carry out the cooling and heating concurrent operation wherein heating is principally performed. At that time, the pressure difference between the evaporating pressure in the indoor heat exchanger 5 of the cooling indoor unit D, and the pressure in the outdoor heat exchange unit 3 becomes smaller because switching to the first main connecting pipe 6 having a greater diameter is made. In addition, at that time, the three way switching valve 8 which are connected to the indoor units B and C have the second ports 8*b* closed, and the first ports 8*a* and the third ports 8*c* opened. The three way switching valve 8 which is connected to the cooling indoor unit D has the first port 8*a* closed, and the second port 8*b* and the third port 8*c* opened. Further, at that time, the first main connecting pipe 6 is at low pressure in it, and the second main connecting pipe 7 is at high pressure in it, which necessarily allows the refrigerant to flow through the fifth check valve 34 and the sixth check valve 35.

In addition, during this cycle, a part of the liquid refrigerant goes from the confluence of the second branch pipes 7*b*, 7*c* and 7*d* in the second branch joint 11 into the bypass pipe 14, is depressurized to a low pressure by the third flow controller 15, carries out heat exchange, at the third heat exchanging portions 16*b*, 16*c* and 16*d*, with the second branch pipes 7*b*, 7*c* and 7*d* in the second branch joint 11, and, at the second heat exchanging portion 16*a*, with the confluence of the second branch pipes 7*b*, 7*c* and 7*d* in the second branch joint 11. The refrigerant, which has been evaporated due to such heat exchange, passes through the first main connecting pipe 6 and the sixth check valve 35, and is inspired into the compressor 1 through the four way reversing valve 2 in the heat source device and the accumulator 4. On the other hand, the refrigerant which has carried out heat exchange at the second and third heat exchanging portions 16*a*, 16*b*, 16*c* and 16*d*, and has been cooled to obtain sufficient sub-cooling enters the indoor unit D which is expected to carry out cooling.

The case wherein cooling is principally performed in cooling and heating concurrent operation will be explained, referring to FIG. 12.

As indicated by arrows of solid line, the refrigerant gas which has been discharged from the compressor 1 enters the outdoor heat exchange unit 3, where the refrigerant gas carries out heat exchange with the air fed by the variable air volume type outdoor fan 20, taking a two phase state having high temperature and high pressure. An arbitrary heat exchange amount can be obtained at the outdoor heat exchange unit 3 by adjusting the air volume from the outdoor fan 20 in a way to bring the pressure detected by the fourth pressure detecting means 18 to a predetermined desired pressure, carrying out the on-off operations of the first, second, third and fourth electromagnetic on-off valves 44, 45, 46 and 47 at the opposite ends of the first and second outdoor heat exchangers 41 and 42 to adjust a heating surface area, and carrying out the on-off operation of the electromagnetic on-off valve 48 in the heat source device bypass passage 43 to adjust the flow rate of the refrigerant which flows through the first and second outdoor heat exchangers 41 and 42. After that, the refrigerant which has taken such two phase state passes through the third check valve 32 and the second main connecting pipe 7, and is forwarded to the gas-liquid separator 12 in the junction devide E. In the gas-liquid separator, the refrigerant is separated into a gaseous refrigerant and a liquid refrigerant. The gaseous refrigerant passes through the first branch joint 10, the three way switching valve 8 and the first branch pipe 6*d* in that order, and enters the indoor unit D which is expected to carry out heating. The gaseous refrigerant carries out heat exchange, at the indoor heat exchanger 5, with the air in the room, and is condensed and liquefied to heat the room. In addition, the refrigerant thus liquefied passes through the first flow controller 9 which is controlled based on the sub-cooling amount at the outlet of the indoor heat exchanger 5 to be substantially fully opened, and the refrigerant is slightly depressurized. Then, the refrigerant enters the second branch joint 11. On the other hand, the liquid refrigerant as remainder passes through the second flow controller 13 which is controlled based on the pressure detected by the first pressure detecting means 25 and that by the second pressure detecting means 26. The refrigerant enters the second branch joint 11, and joins the refrigerant which has passed through the heating indoor unit D. Then, the combined refrigerant passes through the second branch joint 11 and the second branch pipes 7*b* and 7*c* in that order, and enters the indoor units B and C. The refrigerant which has entered the indoor units B and C is depressurized by the first flow controllers 9 which are controlled based on the superheat amounts at the outlets of the indoor heat exchangers B and C. The refrigerant thus depressurized carries out heat exchange with the air in the rooms to be evaporated and gasified, cooling the rooms. In addition, the refrigerant thus gasified passes through the first branch pipes 6*b* and 6*c*, the three way switching valve 8 and the first branch joint 10, and is inspired into the compressor 1 through the first main connecting pipe 6, the fourth check valve 33, the four way reversing valve 2 in the heat source device and the accumulator 4. In this manner, a circulation cycle is formed to carry out the cooling and heating concurrent operation wherein cooling is principally performed. In that time, the three way switching valves 8 which are connected to the indoor units B and C have the first ports 8*a* closed, the second ports 8*b* and the third ports 8*c* opened. The three way switching valve 8 which is connected to the indoor unit D has the second port 8*b* closed, and the first port 8*a* and the third port 8*c* opened. In addition, at that time, the first main connecting pipe 6 is at a low pressure in it, and the second main connecting pipe 7 is at a high pressure in it, which necessarily allows the refrigerant to flow through the third check valve 32 and the fourth check valve 33.

During this cycle, a part of the liquid refrigerant goes from the confluence of the second branch pipes 7*b*, 7*c* and 7*d* into the bypass pipe 14 in the second branch joint 11, is depressurized by the third flow controller 15, and carries out heat exchange, at the third heat exchanging portions 16*b*, 16*c* and 16*d*, with the second branch pipes 7*b*, 7*c* and 7*d* in the second branch joint 11, with the confluence of the second branch pipes 7*b*, 7*c* and 7*d* at the second heat exchanging portion 16*a* in the second branch joint 11, and, at the first heat exchanging portion 19, with the refrigerant which will enter into the second flow controller 13. That part of the liquid refrigerant has been evaporated due to such heat exchange passes through the first main connecting pipe 6 and the fourth check valve 33, and is inspired into the compressor 1 through the four way reversing valve 2 of the heat source device and the accumulator 4. On the other hand, the refrigerant which has been heat exchanged at the first, second and third heat exchanging portions 19, 16*a*, 16*b*, 16*c* and 16*d*, and has been cooled to obtain sufficient sub-cooling in the second branch joint 11 enters the indoor units B and C which are expected to carry out cooling.

Figure 14:
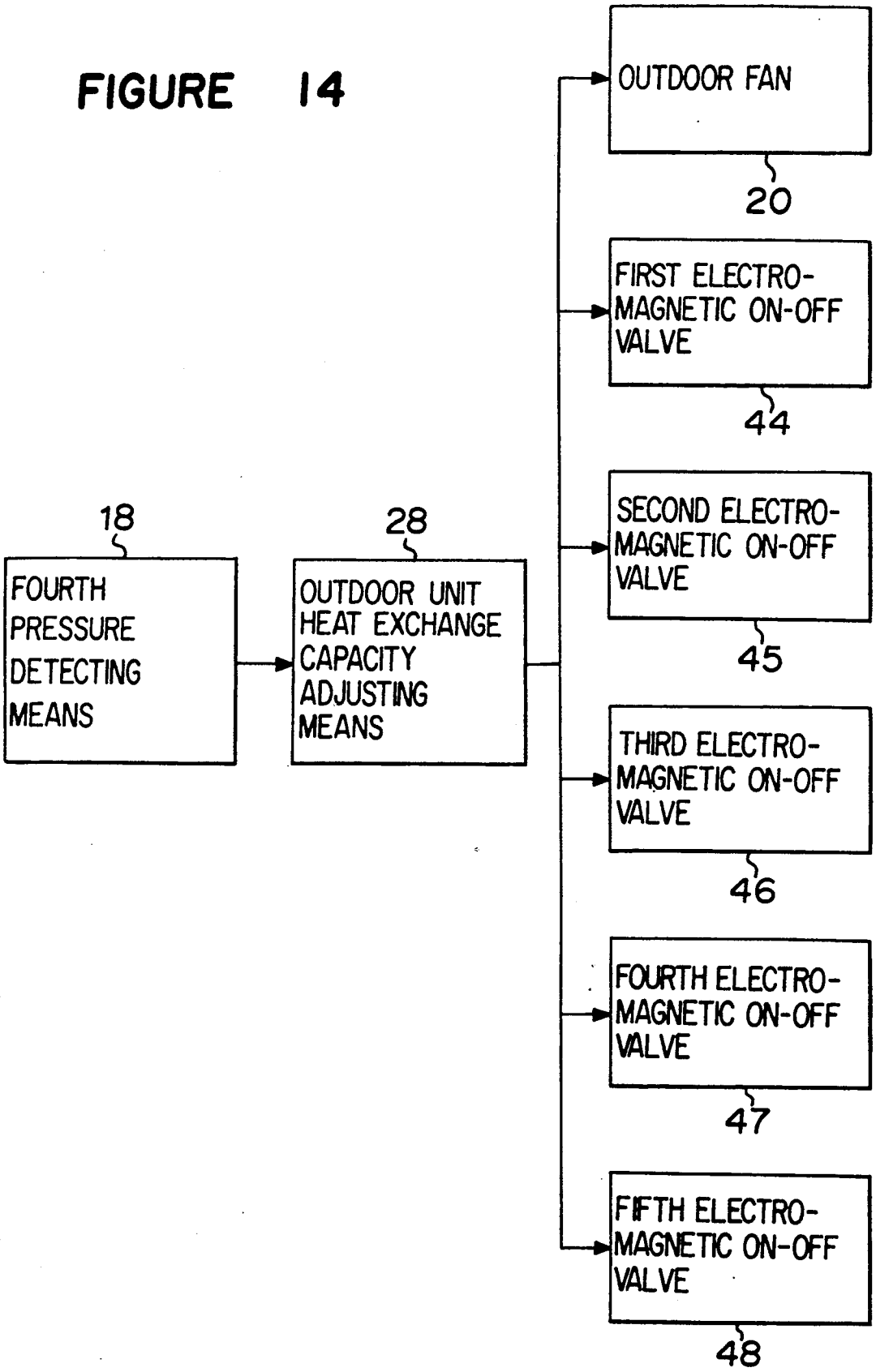
FIG. 14 is a schematic diagram showing a system for adjusting the heat exchange capacity in the outdoor unit of the fifth embodiment.
Figure 15:
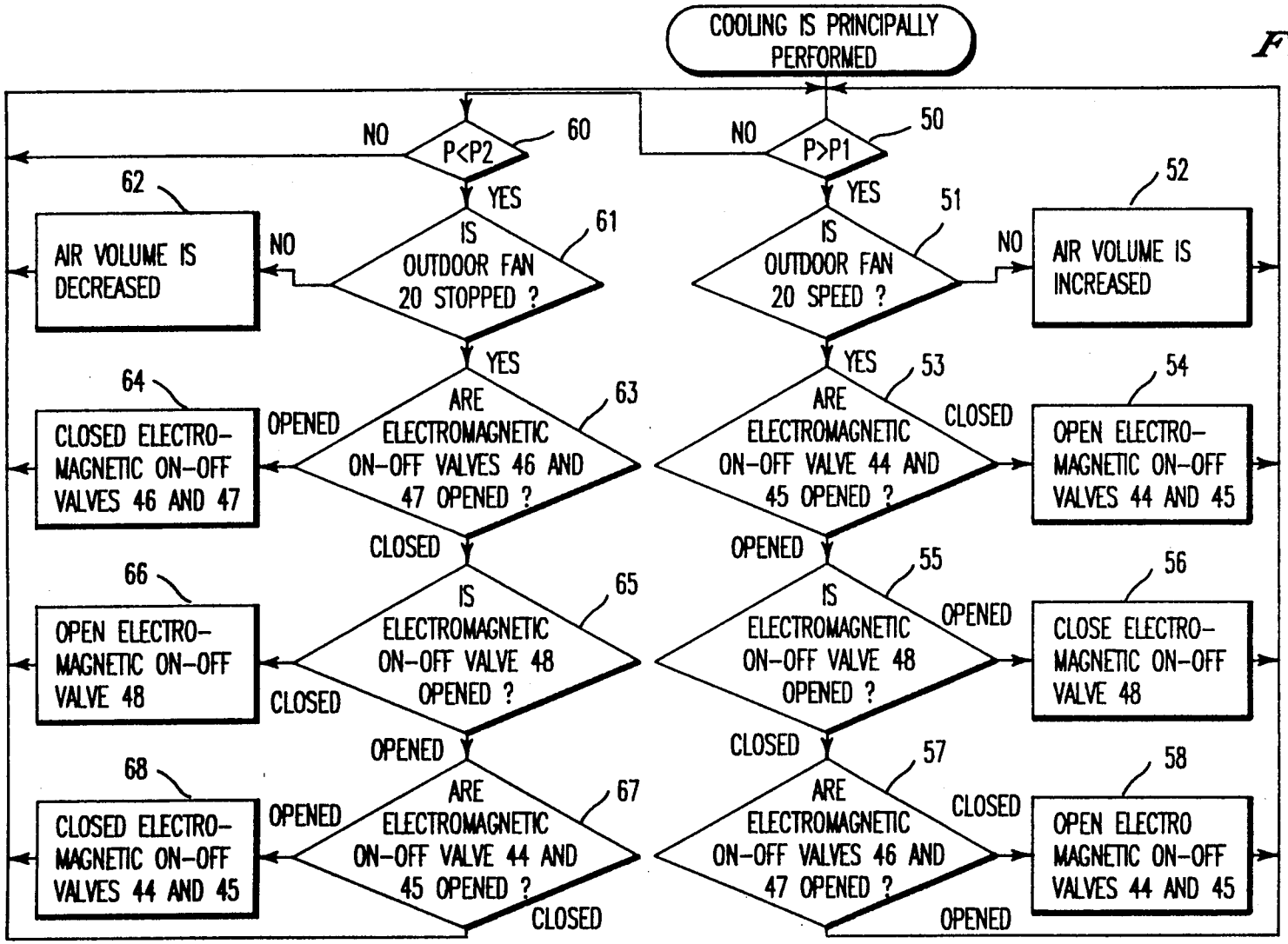
FIGS. 15 and 16 are flow charts for the system for adjusting the heat exchange capacity in the outdoor unit of the fifth embodiment.
Figure 16:
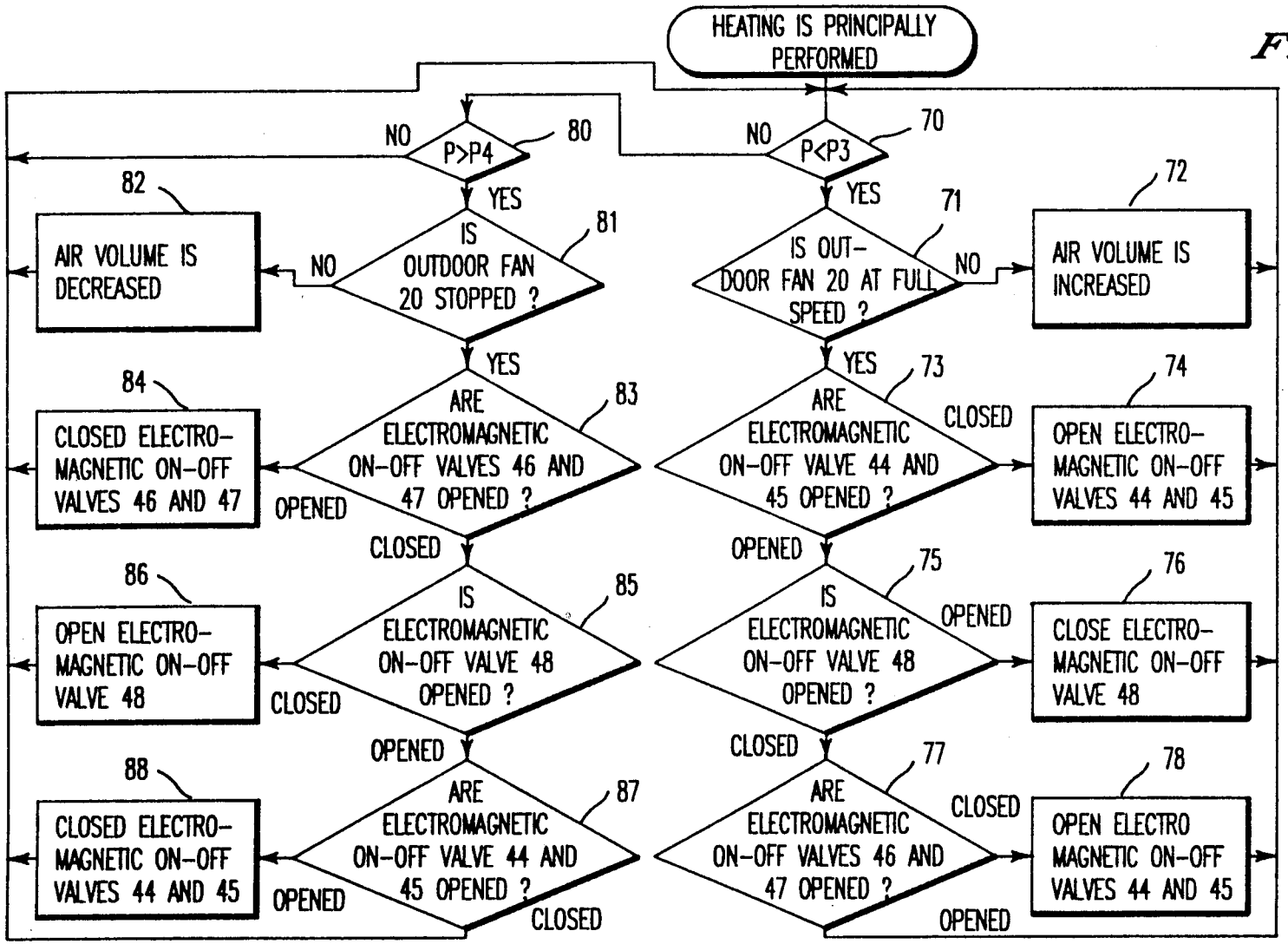
Figure 17:
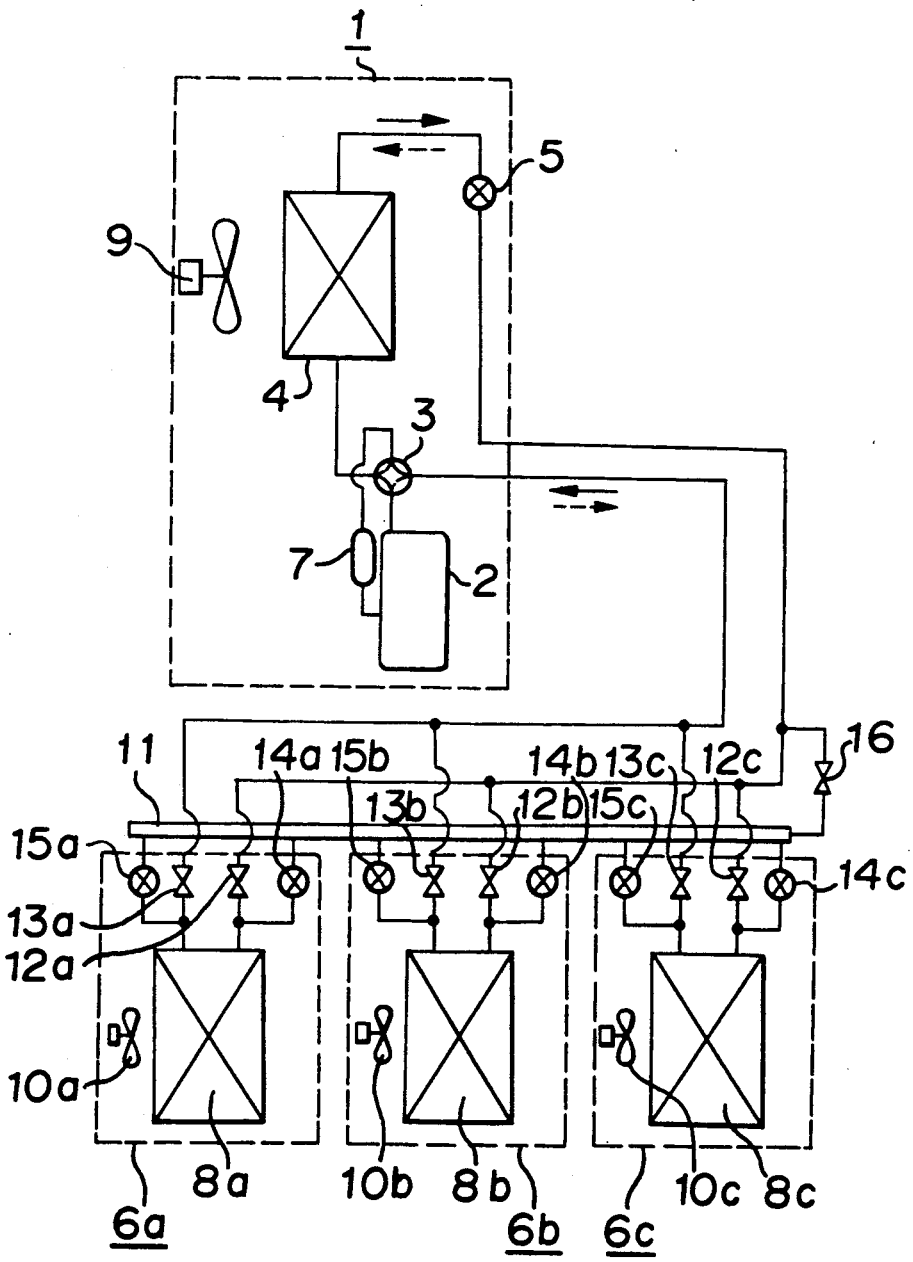
FIGURE 17 PRIOR ART
FIG. 17 is a schematic diagram showing a conventional air conditioning system for multiple rooms.

Now, the controls for the outdoor fan 20, and the first, second, third, fourth and fifth electromagnetic on-off valves 44, 45, 46, 47 and 48 will be explained for the case of the cooling and heating concurrent operation. Referring now to FIG. 14, there is shown a schematic diagram showing a control system for the outdoor fan 20, and the first, second, third, fourth and fifth electromagnetic on-off valves 44, 45, 46, 47 and 48. Reference numeral 28 designates outdoor unit heat exchange capacity adjusting means which controls the air volume from the outdoor fan 20 and the on-off controls of the first, second, third, fourth and fifth electromagnetic on-off valves 44, 45, 46, 47 and 48, depending on the pressure detected by the fourth pressure detecting means 18. Referring now to FIG. 15, there is shown a flow chart showing the control contents of the outdoor unit heat exchange capacity adjusting means for the case of the cooling and heating concurrent operation wherein cooling is principally performed. Referring now to FIG. 16, there is shown a flow chart of the control contents of the outdoor unit heat exchange capacity adjusting means 28 for the case of the cooling and heating concurrent operation wherein heating is principally performed.

The outdoor unit heat exchange capacity adjusting manner which is made by the outdoor unit heat exchange capacity adjusting means 28 will be explained. In the embodiment, the heat exchange capacity is adjusted by one of the following four stages.

The first stage corresponds to a case wherein the greatest heat exchange capacity is required. The first, second, third and fourth electromagnetic on-off valves 44–47 are opened, and the fifth electromagnetic on-off valve 48 is closed, causing the refrigerant to flow through both outdoor heat exchangers 41 and 42, and preventing the refrigerant from passing through the heat source device bypass passage 43. The air volume from the outdoor fan 20 is adjusted between stoppage and full speed by an inverter or the like (not shown). In that case, if there is an external wind such as airflow around building, rather great heat exchange is made even if the outdoor fan is stopped. This means that the cooling capability under the concurrent operation wherein heating is principally performed, and the heating capability under the concurrent operation wherein cooling is principally performed become insufficient. In addition, if there is no external wind, it is impossible to obtain heat exchange capacity not higher than the heat exchange amount by natural convection. This means that if the temperature difference between the external temperature and the condensensing or evaporating temperature of the refrigerant at the outdoor heat exchange unit 3 is great, the cooling capability under the concurrent operation wherein heating is principally performed, and the heating capability under the concurrent operation wherein cooling is principally performed become insufficient.

The second stage corresponds to a case wherein the second greatest heat exchange capacity is required. The first and second electromagnetic on-off valves 44 and 45 are opened, and the third, fourth and fifth electromagnetic on-off valves 46–48 are closed, causing the refrigerant to pass through only the first outdoor heat exchanger 41, and preventing the refrigerant from passing through the second outdoor heat exchanger 42 and the heat source device bypass passage 43. The heating surface area of the outdoor heat exchange unit 3 is reduced by half in that manner. The air volume from the outdoor fan 20 is adjusted between stoppage and full speed by an inverter or the like (not shown). In that case, the heat exchanging amount due to an external wind such as airflow around building can be reduced by half, and the heat exchanging amount due to natural convection at the absence of an external wind can be also reduced by half. This means that the shortage of the cooling capability under the concurrent operation wherein heating is principally performed, and the shortage of the heating capability under the concurrent operation wherein cooling is principally performed have no significant influence.

The third stage corresponds to a case wherein heat exchange capacity smaller than that in the second stage is required. The first, second and fifth electromagnetic on-off valves 44, 45 and 48 are opened, and the third and fourth electromagnetic on-off valves 46 and 47 are closed, causing the refrigerant to pass through the first outdoor heat exchanger 41 and the heat source device bypass passage 43, and preventing the refrigerant from passing through the second outdoor heat exchanger 42. In that manner, the heating surface area of the outdoor heat exchange unit 3 is reduced by half, and flow rate of the refrigerant to the first outdoor heat exchanger 41 is decreased. The air volume from the outdoor fan 20 is adjusted between stoppage and full speed by an inverter or the like (not shown). In that case, the heat exchanging amount due to an external wind such as airflow around building can be further decreased in comparison with the second stage. In addition, the heat exchanging amount due to natural convection at the absence of external wind can be also decreased. As a result, the shortage of the cooling capability under the concurrent operation wherein heating is principally performed, and the shortage of the heating capability under the concurrent operation wherein cooling is principally performed can be minimized.

The fourth stage corresponds to a case wherein the smallest heat exchanging amount is required. The fifth electromagnetic on-off valve 48 is opened, and the first, second, third and fourth electromagnetic on-off valves 44–47 are closed, causing the heat exchanging amount at the outdoor heat exchange unit 3 to become zero. In that case, there is not the heat exchanging amount due to an external wind such as airflow around building at all. There is no shortage of the cooling capability under the concurrent operation wherein heating is principally performed, or no shortage of the heating capability under the concurrent operation wherein cooling is principally performed. Even if there is an external wind, the first stage and the second stage can be successively controlled, provided that the heat exchanging amount $AK2_{MAX}$ of the heat source device which is obtained when the outdoor fan 20 is at full speed is greater than the heat exchange capacity $AK1_{MIN}$ which is obtained at the first stage when there is an external wind and the outdoor fan 20 is stopped, i.e., the wind speed of the external wind satisfies the relation, $AK2_{MAX} > AK1_{MIN}$. Likewise, even if there is an external wind, the second stage and the third stage can be also successively controlled, provided that the heat exchanging capacity $AK3_{MAX}$ in the heat source device which is obtained at the third stage when the outdoor fan 20 is at full speed is greater than the heat exchange capacity $AK2_{MIN}$ which is obtained when there is an external wind and the outdoor fan 20 is stopped at the second stage, i.e., the wind speed of the external wind satisfies the relation, $AK3_{MAX} > AK2_{MIN}$. As explained, even if there is some external wind, the heat exchange capacity of the heat source device can be adjusted in the four stages in the manner as stated earlier to obtain successive heat exchange capacity at the heat source device, obtaining sufficient cooling capability under the concurrent operation wherein heating is principally performed, and sufficient heating capability under the concurrent operation wherein cooling is principally performed, without causing a high pressure to be extraordinarily increased or low pressure to be extraordinarily decreased.

Now, the control content of the outdoor unit heat exchange capacity adjusting means 28 which is made under the concurrent operation wherein cooling is principally performed will be explained, referring to the flow chart of FIG. 15.

At Step 50, a pressure P detected by the pressure detecting means 18 is compared to a predetermined first desired pressure P1. If $P > P1$, the program proceeds to Step 51. At Step 51, it is judged whether the outdoor fan 20 is at full speed or not. If negative, the program proceeds to Step 52 where air volume is increased. Then the program returns to Step 50. If affirmative, the program proceeds to Step 53 where it is judged whether the electromagnetic on-off valves 44 and 45 are opened or not. If negative, the program proceeds to Step 54 where both electromagnetic on-off valves 44 and 45 are opened to activate the first outdoor heat exchanger 41. Then, the program returns to Step 50. If affirmative, the program proceeds to Step 55 where it is judged whether the electromagnetic on-off valve 48 is opened or not. If affirmative, the program proceeds to Step 56 where the electromagnetic on-off valve 48 is closed to inactivate the heat source device bypass passage 43. Then the program returns to Step 50. If negative, the program proceeds to Step 57 where it is judged whether the electromagnetic on-off valves 46 and 47 are opened or not. If negative, the program proceeds to Step 58 where the electromagnetic on-off valves 46 and 47 are opened to activate the second outdoor heat exchanger 42. Then, the program returns to Step 50. Even if affirmative, the program returns to Step 50. On the other hand, if the inequation, $P \leqq P1$, is satisfied at Step 50, the program proceeds to Step 60. At Step 60, the pressure P detected by the pressure detecting means 18 is compared to a predetermined second desired pressure P2 which is set to be smaller than the first desired pressure. If $P < P2$, the program proceeds to Step 61. If $P \geqq P2$, the program returns to Step 50. At Step 61, it is judged whether the outdoor fan 20 is stopped or not. If negative, the program proceeds to Step 62 where the air volume is decreased. Then the program returns to Step 50. If affirmative, the program proceeds to Step 63 where it is judged whether the electromagnetic on-off valves 46 and 47 are opened or not. If affirmative, the program proceeds to Step 64 where the electromagnetic on-off valves 46 and 47 are closed to inactivate the second outdoor heat exchanger 42. Then, the program returns to Step 50. If negative, the program proceeds to Step 65 where it is judged whether the electromagnetic on-off valve 48 is opened or not. If negative, the program proceeds to Step 66 where the electromagnetic on-off valve 48 is opened to activate the heat source device bypass passage 43. Then the program returns to Step 50. If affirmative, the program proceeds to Step 67 where it is judged whether the electromagnetic on-off valves 44 and 45 are opened or not. If affirmative, the program proceeds to Step 68 where the electromagnetic on-off valves 44 and 45 are closed to inactivate the first outdoor heat exchanger 41. Then the program returns to Step 50. Even if negative, the program returns to Step 50. In that manner, the pressure P detected by the pressure detecting means 18 can be brought between P1 and P2.

Next, the control contents of the outdoor unit heat exchange capacity adjusting means 28 which is made under the concurrent operation wherein heating is principally performed will be explained, referring to FIG. 16.

At Step 70, the pressure P detected by the pressure detecting means 18 is compared to a predetermined third desired pressure P3. If $P<P3$, the program proceeds to Step 71. On the other hand, the inequation, $P \geqq P3$, is satisfied at Step 70, the program proceeds to Step 80. At Step 80, the pressure P detected by the pressure detecting means 18 is compared to a predetermined fourth desired pressure P4 which is set to be greater than the third desired pressure. If $P>P4$, the program proceeds to Step 81. If $P \leqq P4$, the program returns to Step 70. The processes which will be made at Steps 71-78 and 81-88 after the program has proceeded to Step 71 or Step 81 are the same as the processes at Steps 51-58 and 61-68 of FIG. 15, and explanation of these Steps will be omitted for the sake of simplicity. In that manner, the pressure P detected by the pressure detecting means 18 can take a value between P3 and P4.

Although in the fifth embodiment the three way switching valves 8 can be provided to selectively connect the first branch pipes 6*b*, 6*c* and 6*d* to either the first main connecting pipe 6 or the second main connecting pipe 7, paired on-off valves such as solenoid valves 30 and 31 can be provided instead of three way switching valves as shown as the sixth embodiment in FIG. 13 to make selective switching, offering similar advantage.

In addition, although in the fifth embodiment the outdoor heat exchange unit 3 is constituted by the two outdoor heat exchangers equal to each other in terms of heating surface area, the outdoor heat exchangers may not be equal to each other in terms of heating surface area, or three or above of outdoor heat exchangers are used to constitute the outdoor heat exchange unit.

Further, although in the fifth embodiment the number of the outdoor heat exchangers which is opened when the heat source device bypass passage 43 is opened is not greater than 1, the number of the outdoor heat exchangers which are opened when the heat source device bypass passage 43 is opened may be two or more.

In the fifth and sixth embodiments, under the concurrent operation wherein heating is principally performed, the gaseous refrigerant which has high pressure is introduced from the heat source device check valve unit, the second main connecting pipe and the first branch joint into the indoor units which are expected to carry out heating. After that, the refrigerant partly goes from the second branch joint into the indoor unit which is expected to carry out cooling. The refrigerant carries out cooling in that indoor unit, and enters the first main connecting pipe through the first branch joint. On the other hand, the remaining refrigerant passes through the fourth flow controller, joins with the refrigerant which has passed through the cooling indoor unit, and enters the first main connecting pipe. Then the refrigerant returns to the heat source device check valve unit, carries out heat exchange at an arbitrary amount at the outdoor heat exchange unit, and returns to the compressor again. In addition, such arbitrary amount of heat exchange can be obtained at the outdoor heat exchange unit by adjusting the air volume from the outdoor fan in a way to bring the pressure detecting by the fourth pressure detecting means to the predetermined desired pressure, carrying out the on-off controls of the electromagnetic on-off valves at the opposite ends of the plural outdoor heat exchangers to adjust heating surface area, and carrying out the on-off control of the electromagnetic on-off valve in the heat source device bypass passage to adjust the flow rate of the refrigerant which flows through the plural outdoor heat exchangers.

Under the concurrent operation wherein cooling is principally performed, the gaseous refrigerant which has high pressure is heat exchanged at the heat source device in an arbitrary amount to take a two phase. The refrigerant which has taken such two phase passes through the second main connecting pipe, and is separated into a gas and a liquid. The gaseous refrigerant thus separated is introduced through the first branch joint into the heating indoor unit to carry out heating there. Then the refrigerant enters the second branch joint. On the other hand, the remaining refrigerant which is the liquid refrigerant separated passes through the second flow controller, and joins, at the second branch joint, which the refrigerant which has passed through the heating indoor unit. The combined refrigerant enters the cooling indoor units to carry out cooling there. After that, the refrigerant is directed from the first branch joint to the heat source device check valve unit through the first main connecting pipe, and returns to the compressor again. An arbitrary amount of heat exchange can be obtained at the outdoor heat exchange unit by adjusting the air volume from the outdoor fan in a way to bring the pressure detected by the fourth detecting means to the predetermined desired pressure, carrying out the on-off controls of the electromagnetic on-off valves at the opposite ends of the plural outdoor heat exchangers to adjust heating surface area, and carrying out the on-off control of the electromagnetic on-off valve in the heat source device bypass passage to adjust the flow rate of the refrigerant which flows through the plural outdoor heat exchangers.

Under sole heating operation, the refrigerant is introduced from the heat source device check valve unit into the indoor units through the second main connecting pipe and the first branch joint to carry out heating at the indoor units. Then the refrigerant returns from the second branch joint to the heat source device check valve unit through the fourth flow controller and the first main connecting pipe.

Under sole cooling operation, the refrigerant is introduced from the heat source device check valve unit into the indoor units through the second main connecting pipe and the second branch joint to carry out cooling at the indoor units. Then the refrigerant returns from the first branch joint to the heat source device check valve unit through the first main connecting pipe.

As explained in the air conditioning system according to the fifth and sixth embodiments, the single heat source device which is constituted by the compressor, the four way reversing valve, the outdoor heat exchange unit, the variable air volume type of outdoor fan for feeding air to the heat exchange unit, and an accumulator is connected, through the first and second main connecting pipes, to the plural indoor units which are constituted by the indoor heat exchangers and the first flow controllers. The first branch joint which includes the valve system capable of selectively connecting one of the indoor heat exchanger of each indoor unit to either the first main connecting pipe or the second main connecting pipe is connected through the second flow controller to the second branch joint which is connected to the other end of the indoor heat exchanger of each indoor unit through the first flow controllers and is also connected to the second main connecting pipe through the second flow controller. The junction device which houses the first branch joint, the second branch joint, the second flow controller and the fourth flow controller is interposed between the heat source device and the plural indoor units. In such arrangement, the outdoor heat exchange unit is constituted by the plural outdoor heat exchangers connected in parallel to each other and having electromagnetic on-off valves at the opposite ends, and the heat source device bypass passage connected in parallel with the outdoor heat exchangers and having the electromagnetic on-off valve in it. The fourth pressure detecting means is arranged between the outdoor heat exchange unit and the outdoor four way reversing valve. There is provided the outdoor unit heat exchange capacity adjusting means which can control the air volume from the outdoor fan, the on-off operations of the electromagnetic on-off valves at the opposite ends of the plural outdoor heat exchangers, and the on-off control of the electromagnetic on-off valve in the heat source device bypass passage is a way to bring the pressure detected by the fourth pressure detecting means to the predetermined pressure. As a result, the plural indoor units can selectively and independently carry out cooling and heating at the same time. Some of the indoor units can carry out cooling while the other indoor units can carry out heating at the same time. In addition, the one which has a greater diameter between the main pipes for extending to connect between the heat source device and the junction device can always utilized at the side of low pressure, thereby improving capability. In particular, in the case wherein heating is principally performed under the concurrent operation, the main pipe having a greater diameter can be utilized at the side of low pressure to decrease the difference between the evaporating pressure of the indoor heat exchanger(s) of cooling indoor unit(s) and that in the outdoor heat exchanger. As a result, the evaporating pressure in the indoor heat exchanger(s) can be increased to prevent cooling capability from being short. In addition, the evaporating pressure at the outdoor heat exchanger can be lowered to prevent the heat exchanger from being iced and capability from lowering in operation. Further, even if there is a great difference between an external air temperature and the condensation or evaporating temperature of the refrigerant at the outdoor heat exchange unit, or there is some external air, the heat exchange capacity at the heat source device can be obtained at a successive form. As a result, the pressure at the high pressure side is prevented from extraordinarily raising, and the pressure at the low pressure side is prevented from extraordinarily lowering. The cooling capability under the concurrent operation wherein heating is principally performed, and the heating capability under the concurrent operation wherein cooling is principally performed can be obtained in a sufficient form.

What is claimed is:

1. An air conditioning system for multiple rooms, comprising:

an outdoor unit including a variable delivery compressor, a four way reversing valve and an outdoor heat exchange unit;

two main connecting pipes composed of a high pressure main pipe and a low pressure main pipe to connect between outdoors and indoors;

a distribution controller which is connected to the main connecting pipes to divide them into a high pressure pipe, a low pressure pipe and a medium pressure pipe therein;

a plurality of indoor units which include indoor heat exchangers, respectively, which are one end connected to the medium pressure pipe through electronic expansion valves, respectively, and which are the other end selectively connected to either one of the high pressure pipe and the low pressure pipe, respectively;

detecting means for detecting either one of refrigerant temperatures and refrigerant pressures; and control means for carrying out a predetermined control based on such detection.

2. An air conditioning system according to claim 1, wherein:

the detecting means is constituted by air temperature sensors for detecting intake air temperatures Tai at the indoor heat exchangers, and first refrigerant sensors and second refrigerant sensors for detecting refrigerant temperatures TR1 at the refrigerant inlets of the indoor heat exchangers and refrigerant temperatures TR2 at the refrigerant outlets thereof, respectively; and the control means controls the electronic expansion valves of the indoor heat exchangers based on logarithmic mean temperature differences at the respective indoor heat exchangers, and on desired temperatures and actual temperatures of rooms with the indoor units installed therein.

3. An air conditioning system according to claim 1, wherein:

the detecting means is constituted by either one of pressure detecting means for detecting a pressure at a high pressure pipe and a pressure at a low pressure pipe in the outdoor unit, and temperature detecting means for detecting a condensing temperature and an evaporating temperature;

there is provided calculation means for making calculation using either one of the following equations:

$$\left(\frac{\Delta Q_{comp}}{\Delta Ake}\right)=\begin{pmatrix} A & B \\ C & D \end{pmatrix}\begin{pmatrix} \Delta Pd \\ \Delta Ps \end{pmatrix} \text{and}$$

$$\left(\frac{\Delta Q_{comp}}{\Delta Ake}\right)=\begin{pmatrix} A' & B' \\ C' & D' \end{pmatrix}\begin{pmatrix} \Delta CT \\ \Delta ET \end{pmatrix}$$

wherein ΔQcomp is a capacity variable for the compressor, ΔAke is a heat exchange capacity variable for the outdoor heat exchanger, A, B, C, D, A', B', C' and D' are constants, ΔPd is a controlled deviation between a desired value and a detected value at the high pressure pipe in the outdoor unit, ΔPs is a controlled deviation between a desired value and a detected value at the low pressure pipe in the outdoor unit, ΔCT is a controlled deviation between a desired value and a detected value with respect to the condensing temperature, and ΔET is a controlled deviation between a desired value and a detected value with respect to the evaporating temperature; and the control means controls the compressor, the four way reversing valve in the outdoor unit and the outdoor heat exchange unit based on such calculation.

4. An air conditioning system according to claim 1, wherein:

the outdoor unit includes an outdoor fan;

the outdoor heat exchange unit comprises a plurality of outdoor heat exchangers connected in parallel;

at least one of the outdoor heat exchangers is provided with an on-off valve;

a bypass passage is connected in parallel with the outdoor heat exchangers, and having an on-off valve therein;

the detecting means is constituted by a high pressure detecting means arranged in the outdoor unit for detecting a high pressure Pd, and a low pressure detecting means arranged in the outdoor unit for detecting a low pressure Ps; and the control means finds a compressor capacity variable ΔQcomp and an outdoor unit heat exchange variable ΔAk0 based on a controlled deviation (ΔPd=Pd*−Pd) between a desired high pressure Pd* and the detected high pressure, and a controlled deviation (ΔPs=Ps*−Ps) between a desired low pressure Ps* and the detected low temperature, thereby to control the capacity of the compressor based on the found ΔQcomp, and also to control the heat exchange capability of the outdoor heat exchange unit by controlling the on-off valve of the at least one outdoor heat exchanger, the bypass passage on-off valve and the outdoor fan based on the found ΔAk0.

5. An air conditioning system according to claim 1, wherein:

the outdoor unit includes an outdoor fan;

the outdoor heat exchange unit comprises a plurality of outdoor heat exchangers connected in parallel;

at least one of the heat exchangers is provided with an on-off valve;

a bypass passage is connected in parallel with the outdoor heat exchangers, and having an on-off valve therein;

the detecting means is constituted by detecting means for detecting a refrigerant condensing temperature CT and a refrigerant evaporating temperature ET in the outdoor unit and the indoor units; and the control means finds a compressor capacity variable ΔQcomp and an outdoor unit heat exchange variable ΔAk0 based on a controlled deviation (ΔCT=CT*−CT) between a desired condensing temperature CT* and the detected condensing temperature, and a controlled deviation (ΔET=ET*−ET) between a desired evaporating temperature ET* and the detected evaporating temperature, thereby to control the capacity of the compressor based on the found ΔQcomp and, also to control the heat exchange capability of the outdoor heat exchange unit by controlling the on-off valve of the at least one outdoor heat exchanger, the bypass passage on-off valve and the outdoor fan based on the found ΔAk0.

6. An air conditioning system comprising:

a single outdoor unit including a compressor, a four way reversing valve, an outdoor heat exchange unit, a variable air volume type of outdoor fan for feeding air to the outdoor heat exchange unit, and an accumulator;

a first main connecting pipe and a second main connecting pipe;

a plurality of indoor units connected to the outdoor unit through the main connecting pipes, and including indoor heat exchangers and first flow controllers;

a first branch joint which is provided with valve systems to selectively connect one end of the indoor heat exchangers to either one of the first main connecting pipe and the second main connecting pipe;

a second branch joint which is connected to the other end of the indoor heat exchangers through the first flow controllers, and which is also connected to the second main connecting pipe through a second flow controller;

the first branch joint and the second branch joint being connected together through the second flow controller;

the second branch joint and the first main connecting pipe being connected together through a fourth flow controller;

a junction device which includes the first branch joint, the second branch joint, the second flow controller and the fourth flow controller, and which is interposed between the outdoor unit and the indoor units;

the outdoor heat exchange unit being constituted by a plurality of outdoor heat exchangers connected together in parallel and having both ends provided with electromagnetic on-off valves, and an outdoor bypass passage connected in parallel with the outdoor heat exchangers and having an electromagnetic on-off valve therein;

a fourth pressure detecting means arranged at a location between the outdoor heat exchangers and the four way reversing valve; and an outdoor unit heat exchange capacity adjusting means for controlling the air volume of the outdoor fan, the electromagnetic on-off valves at both ends of the outdoor heat exchangers and the electromagnetic on-off valve in the outdoor bypass passage so that the pressure detected by the fourth pressure detecting means achieves a desired pressure.

* * * * *